US009343795B1

(12) United States Patent
Halligan et al.

(10) Patent No.: US 9,343,795 B1
(45) Date of Patent: May 17, 2016

(54) WIDEBAND UNBALANCED WAVEGUIDE POWER DIVIDERS AND COMBINERS

(71) Applicant: Sandia Corporation, Albuquerque, NM (US)

(72) Inventors: Matthew Halligan, Albuquerque, NM (US); Jacob Jeremiah McDonald, Albuquerque, NM (US); Bernd H. Strassner, II, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 109 days.

(21) Appl. No.: 14/444,843

(22) Filed: Jul. 28, 2014

Related U.S. Application Data

(60) Provisional application No. 61/859,384, filed on Jul. 29, 2013.

(51) Int. Cl.

| | |
|---|---|
| ***H01P 5/12*** | (2006.01) |
| ***H01P 5/16*** | (2006.01) |
| ***H01P 3/12*** | (2006.01) |
| ***H01P 11/00*** | (2006.01) |

(52) U.S. Cl.
CPC .. *H01P 5/16* (2013.01); *H01P 3/12* (2013.01); *H01P 11/002* (2013.01)

(58) Field of Classification Search
CPC ..... H01P 5/16; H01P 3/12; H01P 11/002; H01P 5/00; H01P 5/12
USPC ..... 333/125, 137
See application file for complete search history.

(56) References Cited

U.S. PATENT DOCUMENTS

| | | | | |
|---|---|---|---|---|
| 3,089,103 | A * | 5/1963 | Oliner | H01P 5/16 333/125 |
| 3,932,822 | A * | 1/1976 | Salzberg | H01P 5/12 333/117 |
| 4,200,847 | A * | 4/1980 | Nishikawa | H01P 1/2138 333/125 |
| 4,849,720 | A * | 7/1989 | Call | H01P 5/19 333/125 |
| 2013/0154764 | A1 | 6/2013 | Runyon et al. | |

OTHER PUBLICATIONS

D. Panda, et al., "Analysis of a 1:2 Rectangular Waveguide Power Divider for Phased Array Application Using Multiple Cavity modeling Technique", Progress in Electromagnetics Research Symposium, Jul. 2-6, 2008, IEEE India, pp. 361-368 (2008).

C. Nantista, et al., "A Compact, Planar, Eight-Port Waveguide Power Divider/Combiner: The Cross Potent Superhybrid", Stanford Linear Accelerator Center, Stanford University, SLAC-PUB-8771, Feb. 2001, pp. 1-4 (2001).

(Continued)

*Primary Examiner* — Robert Pascal
*Assistant Examiner* — Kimberly Glenn
(74) *Attorney, Agent, or Firm* — Medley, Behrens & Lewis, LLC

(57) ABSTRACT

The various technologies presented herein relate to waveguide dividers and waveguide combiners for application in radar systems, wireless communications, etc. Waveguide dividers-combiners can be manufactured in accordance with custom dimensions, as well as in accordance with waveguide standards such that the input and output ports are of a defined dimension and have a common impedance. Various embodiments are presented which can incorporate one or more septum(s), one or more pairs of septums, an iris, an input matching region, a notch located on the input waveguide arm, waveguide arms having stepped transformer regions, etc. The various divider configurations presented herein can be utilized in high fractional bandwidth applications, e.g., a fractional bandwidth of about 30%, and RF applications in the Ka frequency band (e.g., 26.5-40 GHz).

19 Claims, 14 Drawing Sheets

(56) References Cited

OTHER PUBLICATIONS

S. Das, et al., "Analysis of Multiport Waveguide Power Divider/Combiner for Phased Array Application", Joint Telematics Group (JTG)—India, National Conference on Communications 2007, pp. 336-340 (2007).

B. Rahali, et al., "Design of K-Band Substrate Integrated Waveguide Coupler, Circulator and Power Divider", International Journal of Information and Electronics Engineering, vol. 4, No. 1, Jan. 2014, pp. 47-53 (2014).

* cited by examiner

WIDEBAND UNBALANCED WAVEGUIDE POWER DIVIDERS AND COMBINERS

RELATED APPLICATION

This application claims priority to U.S. Provisional Patent Application No. 61/859,384, filed on Jul. 29, 2013, and entitled "WIDEBAND UNBALANCED WAVEGUIDE POWER DIVIDERS", the entirety of which is incorporated herein by reference.

STATEMENT OF GOVERNMENTAL INTEREST

This invention was developed under contract DE-AC04-94AL85000 between Sandia Corporation and the U.S. Department of Energy. The U.S. Government has certain rights in this invention.

BACKGROUND

Routing radio frequency (RF) signals from a source to an antenna array can involve many power dividers/couplers (e.g., "T" splitters) to properly feed antenna elements with a desired signal and/or signal strength. Two common approaches for such routing utilize printed circuit board type power dividers (e.g., microstrip or stripline dividers) or waveguide power dividers. Microstrip or stripline dividers are often used in applications that have wideband frequency operation and unbalanced power divisions. However, microstrip or stripline dividers can suffer from various signal losses (e.g., a high insertion loss) which can limit a maximum sensitivity of a communication apparatus that utilizes these types of dividers.

Waveguide dividers are desired due to their ability to be utilized with increased bandwidth in conjunction with low loss properties to facilitate increased system resolution in remote sensing applications and increased data transfer for wireless communications. However, wideband, unbalanced waveguide power dividers and combiners are not commonly utilized in radar systems, wireless communications, and other applications as there is little information available in literature regarding the design of such dividers and combiners. Accordingly, waveguide dividers are conventionally utilized used in narrowband applications (e.g., 5-10% fractional bandwidth) which utilize balanced power divisions. Typical unbalanced waveguide power dividers used in the aforementioned applications have a narrow operational bandwidth (e.g., less than 2.0% fractional bandwidth).

A number of challenges can be encountered during the design of wideband unbalanced waveguide power dividers, where such challenges can include:

a) Waveguides are not easily designed for broadband applications due to their dispersive nature.

b) There is minimal information available on how to formulate an unbalanced splitter design, and further, how to create a design that satisfies requirements regarding return loss, insertion loss, and/or phase balance.

c) Conventional coupler designs may be used to achieve desired power splits, but these designs have a much larger footprint (e.g., 2× or more) compared to a balanced waveguide divider, whereby the increase in size can be due to coupling through the broad wall of the waveguide, for example.

d) Conventional design methodologies to fabricate unique unbalanced waveguide power dividers with similar footprints to balanced dividers can be time intensive. For example, an impact on an electrical performance by various lengths/sizes is not well known, and accordingly, parametric sweeps of many different waveguide dimensions/features are required in electromagnetic modeling tools for each unique divider design.

SUMMARY

The following is a brief summary of subject matter that is described in greater detail herein. This summary is not intended to be limiting as to the scope of the claims.

The various embodiments presented herein relate to unbalanced waveguide power dividers and power combiners. The waveguide dividers can be utilized in narrowband and wideband applications, e.g., in an application requiring high fractional bandwidth. In an aspect, the various waveguide dividers presented herein, and the associated methodologies of design, can result in design times that are faster by an order of magnitude or more over conventional design methods. The resulting designs can meet demanding RF performance requirements, e.g., with regard to such parameters as return loss, insertion loss, phase balance, etc.

Further, the various embodiments presented herein facilitate design and construction of radar or antenna array systems which are smaller and lighter in comparison with conventional arrays, while operating with losses which are also less than those encountered in a conventional system. In an aspect, a reduction in operational losses can enable improved system sensitivity.

A plurality of designs are presented, where such designs utilize a combination of any of a main septum, an iris, one or more pair of resonant septums, a notched input waveguide arm, and various transformer regions such as an input matching section, stepped transformers, etc. In accordance with the various embodiments presented herein, waveguide dividers can be manufactured to satisfy various requirements of waveguide standards. For example, waveguide dividers can be fabricated such that the respective sizes (e.g., aperture sizes) of the input port and output ports are in accordance with a WR-28 standard, for Ka band frequencies (e.g., 26.5-40 GHz). In another embodiment, aperture sizes for the respective ports of a waveguide divider are also customizable, and accordingly, do not have to comply with a particular waveguide standard.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
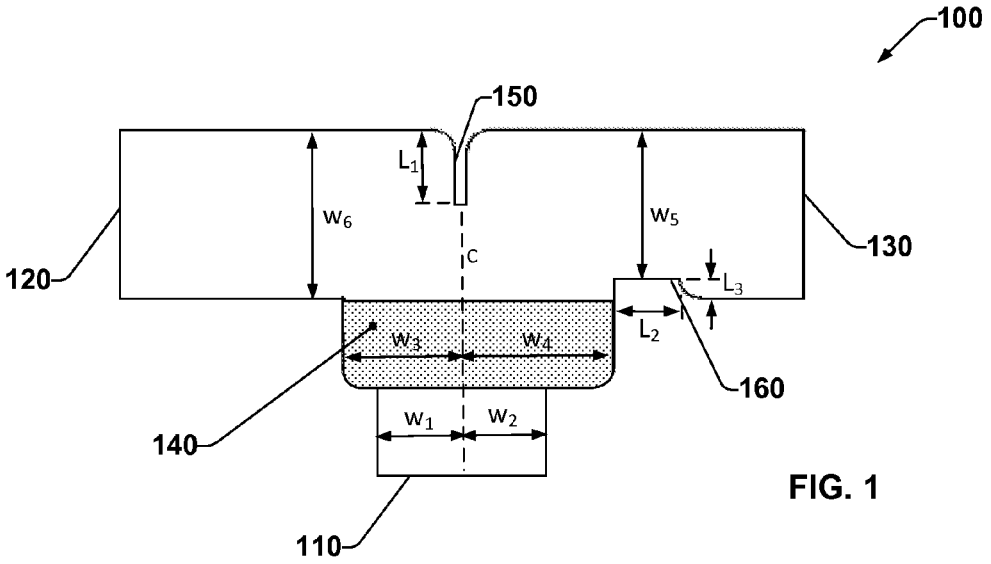
FIG. 1 is a block diagram illustrating a waveguide divider.

Various technologies pertaining to waveguide dividers are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

Moreover, the term "or" is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference.

The various embodiments presented herein relate to formation of waveguide dividers for applications requiring high fractional bandwidth operation. Eqn. 1, defines fractional bandwidth (FB):

$$FB = \frac{\text{highest operational frequency} - \text{lowest operational frequency}}{\text{center frequency of operation}} \quad \text{Eqn. 1}$$

In an aspect, a fractional bandwidth of up to about 30% can be desired for operation of an unbalanced antenna array. While the various embodiments presented herein are directed towards Ka band frequencies (e.g., 26.5-40 GHz), the embodiments are not so limited, and can be applied to any desired frequency range and/or waveguide standard. Furthermore, while the various embodiments are directed towards T-junction waveguide power dividers they can also be directed towards T-junction waveguide power combiners, or a combination thereof.

The various embodiments presented herein relate to an air-filled waveguide which can be machined into a standard waveguide block or substrate (e.g., an aluminum substrate). In an aspect, the various embodiments presented herein can be directed towards an in-phase H-plane, unequal way, T-junction, which can be formed by removing material in the substrate to form a first waveguide arm comprising a first port at one end. Second and third waveguide arms can be formed in a collinear arrangement and respectively comprise second and third ports. Depending upon the fabrication process, structures forming any of the first, second, or third waveguide arms can be formed by material removal (e.g., machining) or built-up by press-in, brazing, bonding, soldering, or similar fabrication process. The waveguide cavity formed by the first waveguide arm, the second waveguide arm and the third waveguide arm can be formed by placing a lid over the machined regions formed in the substrate. In an embodiment, a film or layer (e.g., aluminum foil) can be placed between the substrate and the lid to facilitate sealing of any gap that may occur between the substrate and the lid.

To facilitate understanding of the various embodiments presented herein, various desired electrical characteristics of the waveguide power dividers and combiners are now described. Desired characteristics can include:

a) Most of the input power is to be transmitted through the waveguide structure (indicated by the return loss value, $|S_{11}|$).

b) The actual power split engendered by the waveguide structure is to be close to the desired values (indicated by the insertion loss values $|S_{21}|$ and $|S_{31}|$).

c) The phase balance is to be zero, or alternatively stated, the phase progression of the waves from the input port to the output ports is to be approximately the same (indicated from the insertion loss phase angle ($S_{21}$) and angle ($S_{31}$)).

Further, regarding the phase balance, a zero degree phase balance can be desired over a wide frequency range as for remote sensing applications a zero degree phase balance facilitates antenna elements to be fed with the same phase.

Figure 2:
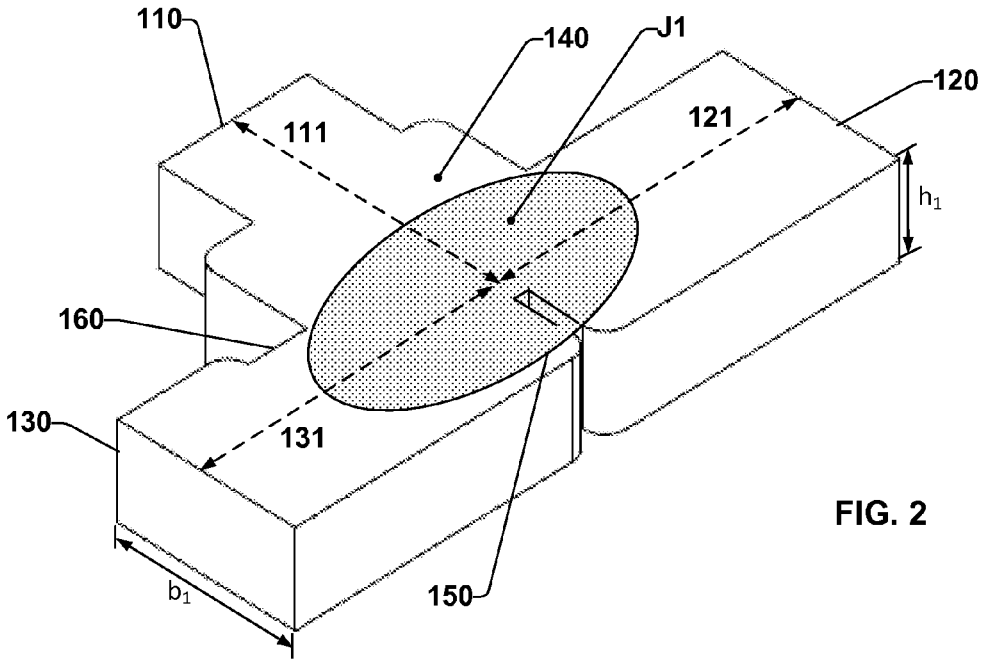
FIG. 2 is a block diagram illustrating a waveguide divider.

FIGS. 1 and 2 illustrate a waveguide divider 100, FIG. 1 is a plan or top view, while FIG. 2 is an oblique 3D view or a perspective view. The waveguide divider 100 comprises two output waveguide arms 121 and 131 that have respective ports 120 and 130. The waveguide divider 100 also includes an input waveguide arm 111 that has an input port 110, wherein the input waveguide arm 111 connects the input port 110 with the two output waveguide ports 120 and 130 of the output waveguide arms 121 and 131, respectively. In an aspect, the waveguide divider 100 can have a "T" shaped geometry (e.g., a "T" splitter), whereby the input waveguide arm 111 and input port 110 form the column of the "T" shape, while the two output waveguide arms 121 and 131, and respective ports 120 and 130, combine to form the lintel of the "T" shape. In an embodiment, the waveguide divider 100 can be utilized to split a signal (e.g., a RF signal) in an unbalanced manner, such that a signal input at port 110 can be separated in an uneven manner between port 120 and port 130. In an aspect, the RF signal is divided into a first portion that is directed along the waveguide arm 121, and a second portion that is directed along the waveguide arm 131.

In an embodiment, the respective size and impedance of ports 110, 120, and 130 can be equal, and based upon such equality, the size and placement of other features which form waveguide divider 100 can be positioned accordingly, as further described herein. For example, the dimensioning of waveguide divider 100 (and other waveguide dividers 700 and 1300 presented herein) can be based upon the waveguide standard WR-28, which can be utilized when operating in the Ka frequency band (e.g., 26.5-40 GHz). Accordingly, standard WR-28 specifies inside dimensions (or apertures) of the ports 110, 120, and 130 to each be 7.112 mm ($b_1$)×3.556 mm ($h_1$) (0.280"×0.140") and having a characteristic impedance for the standard, e.g., to enable insertion of the various waveguide divider configurations presented herein into antenna systems configured to the WR-28 standard. However, as previously mentioned, the respective dimensions of the ports 110, 120, and 130 can be of any desired dimension, for example, in an embodiment, $b_1$=about 7.4 mm and $h_1$=about 3.7 mm.

With regard to a degree of unbalance, a waveguide divider which operates in a balanced manner can be expressed as a 50:50 waveguide divider, with an input signal being shared equally between two output ports. However, an unbalanced waveguide divider can operate in any division ratio, whereby a signal having a magnitude of 100% is divided in an x:y ratio of imbalance, whereby x and y are non-equal values that add to 100%. For example, in an embodiment, a waveguide divider can operate in a 64.5:35.5 ratio (which can be considered to be in a moderate degree of unbalance). In another embodiment, an unbalanced waveguide divider can operate in an 83.1:16.9 manner (which can be considered to be in a high degree of unbalance). It is to be appreciated that while various degrees of balancing are presented herein, the various embodiments are applicable to any degree of balancing from 50:50 (balanced) through to about 100:0 (severely unbalanced). It is to be appreciated that in some applications multiple unbalanced waveguide power dividers with unique power divisions can be cascaded together to form beam forming networks.

A number of features can be appropriately positioned and sized to achieve the desired degree of signal unbalance. As shown in the embodiment presented in FIGS. 1 and 2, a first feature, an input matching section 140 (e.g., the shaded region, also known as a transformer, or a transformer region) can be positioned about a centerline c, whereby centerline c can be positioned relative to a midpoint of the first port 110, for example, distances $w_1$ and $w_2$ can be of equal length about centerline c. Accordingly, the input matching section 140 can be positioned offset to the centerline c such that distance $w_3$ is different to a distance $w_4$, (e.g., distance $w_3$ is less than, or greater than, distance $w_4$).

In an aspect, adjustment of the position of the input matching section 140 about the centerline c can affect the reactive nature of a junction J1 between the waveguide arms 111, 121, and 131. In another aspect, adjustment of the position of the input matching section 140 about the centerline c can adjust the input impedance at the input port 110 to a value that is useable with regard to the desired characteristic impedances of input port 110 and output ports 120 and 130 (e.g., the characteristic impedances of ports 110, 120 and 130 are equal to satisfy a waveguide standard). In another aspect, the relative positional offset of input matching section 140 (e.g., length $w_3$ relative to $w_4$) can also affect the signal power split (e.g., a first signal portion and a second signal portion) between the waveguide arm 121 and the waveguide arm 131 with the offset properties. For the example, from a field propagation viewpoint, with the configuration presented in FIG. 1, where $w_4>w_3$, more signal power is directed out of the output port 130.

Further, a septum 150 (e.g., a main septum) can be incorporated into the divider 100 to further split the input signal into the first signal portion and the second signal portion. In an embodiment, the septum 150 can be placed on the centerline c of the first port 110. In another embodiment, either, or both of the input matching section 140 and/or the septum 150 can be offset from the centerline c. The septum 150 can have a length of $L_1$, whereby the length $L_1$ can be customized. The septum 150 can be utilized to tune out capacitance at the junction J1.

An iris 160 (e.g., a narrowed region) can be incorporated into the waveguide divider 100. As shown in the particular embodiment presented in FIG. 1, the iris 160 can result in the profile of one arm (e.g., the waveguide arm 131) to be configured different to the profile of the other arm (e.g., the waveguide arm 121). The iris 160 can have a size $L_2$×$L_3$. Further, the iris 160 can be placed adjacent to an edge of the input matching section 140. In an aspect, when the dimension $L_2$ is small, the iris 160 can act as an inductive septum. Incorporation of the iris 160 can result in a transformation of an impedance formulated from waveguide dimensions for waveguide arm 131 to a different impedance. For example, the iris 160 can cause an input into the third port 130 (e.g., when looking at the third port 130 from the junction J1) to have a feature of a waveguide with a high characteristic impedance (e.g., no reactance) at a desired frequency, accordingly an impedance is transformed to a higher impedance. In an aspect, with the configuration presented in waveguide divider 100, a greater amount (or magnitude) of signal power can be directed along waveguide arm 131 compared to the amount (or magnitude) of signal power directed along waveguide arm 121, resulting in the power unbalance.

It is to be appreciated that while a higher equivalent impedance may be seen into waveguide arm 131, a higher power split can be achieved based upon the offset design of the input matching section 140 and the septum 150, as previously described. The input matching section 140, the septum 150, and the size and place of iris 160 can interact as follows with regard to signal splitting and control. Essentially, the power can be split preferentially by guiding electromagnetic waves to one waveguide arm (e.g., waveguide arm 130) relative to the other waveguide arm (e.g., waveguide 120). With an offset 140 (e.g., $w_4>w_3$), more signaling can be directed to the waveguide arm where the w dimension is largest in the input matching section 140. In the embodiment presented in FIG. 1, $w_4$ is larger and hence, more signal power is directed out of port 130. The septum 150 can also facilitate the power division across the waveguide arms.

In an aspect, to compensate for differences in a field propagation path length between the two output waveguide arms 120 and 130, the iris 160 can act to increase a signaling phase velocity. Thus the iris 160 can act to correct phase balance experienced between the waveguide arms 120 and 130. However, incorporating the iris 160 can introduce issues with achieving a desired power split between the waveguide arms 120 and 130.

An effect of the iris 160 is that iris 160 can transform a waveguide impedance formed by the waveguide port dimensions at port 130 to a larger impedance when $L_2$ is approximately one fourth the waveguide wavelength (e.g., acting as a quarter wavelength transformer). In an embodiment, where $L_2$ is close to being one fourth the wavelength over an analyzed frequency band, the input impedance from the junction J1 to port 130 can appear higher than looking into port 120. In an aspect, owing to a greater amount of electromagnetic waves can propagate out a waveguide arm which has a smaller input impedance as seen from the junction J1 for a symmetric structure, asymmetry between the input matching section 140 and the septum 150 can be utilized to influence the power flow through the waveguide divider 100. The input matching section 140 and the septum 150 can be designed to facilitate a greater amount of signal power is directed into port 130 despite a higher input impedance, as shown in the divider 100.

Thus it can be seen that many of these design features are "coupled" to achieve the desired electrical performance (e.g., return loss, insertion loss, phase balance, etc.)

As previously mentioned, power division (e.g., power unbalance) can be controlled in waveguide divider 100 by any of (a) a degree of offset of the input matching section 140 (e.g., respective distances $w_3$ and $w_4$ relative to centerline c), (b) a degree of offset of the septum 150, and/or (c) adjusting a length and/or width of the iris 160.

Further, an input return loss for the waveguide divider 100 can be controlled by adjusting the respective length(s) and/or respective width(s) of the input matching section 140 and/or the septum 150.

Furthermore, the phase imbalance of waveguide divider 100 can be controlled by adjusting the length and/or width of the iris 160.

Figure 3:
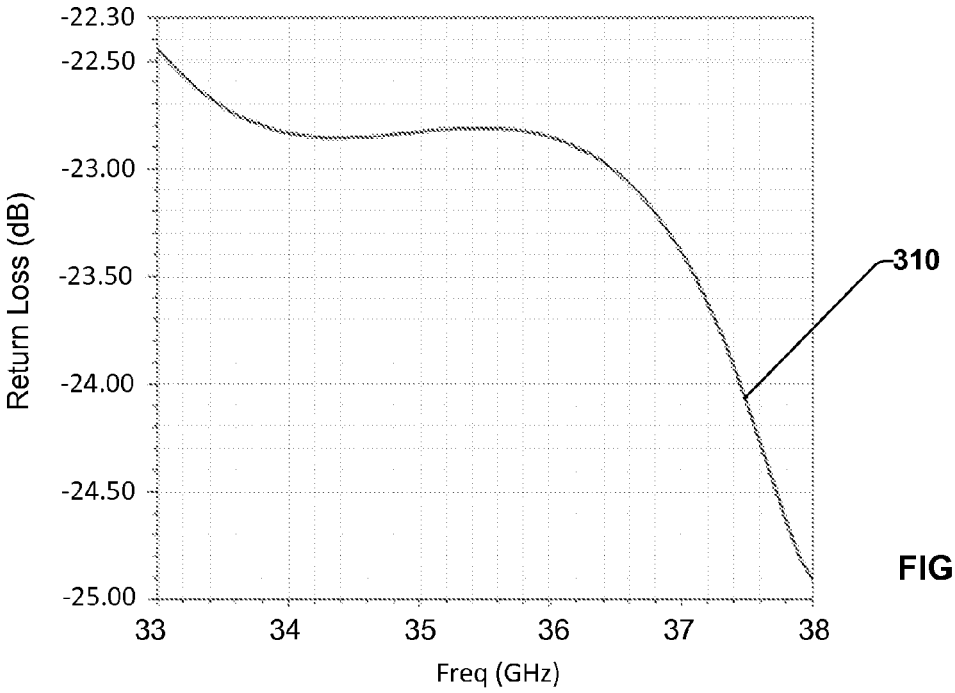
FIG. 3 is a plot of input return loss as a function of frequency for a waveguide divider.
Figure 4:
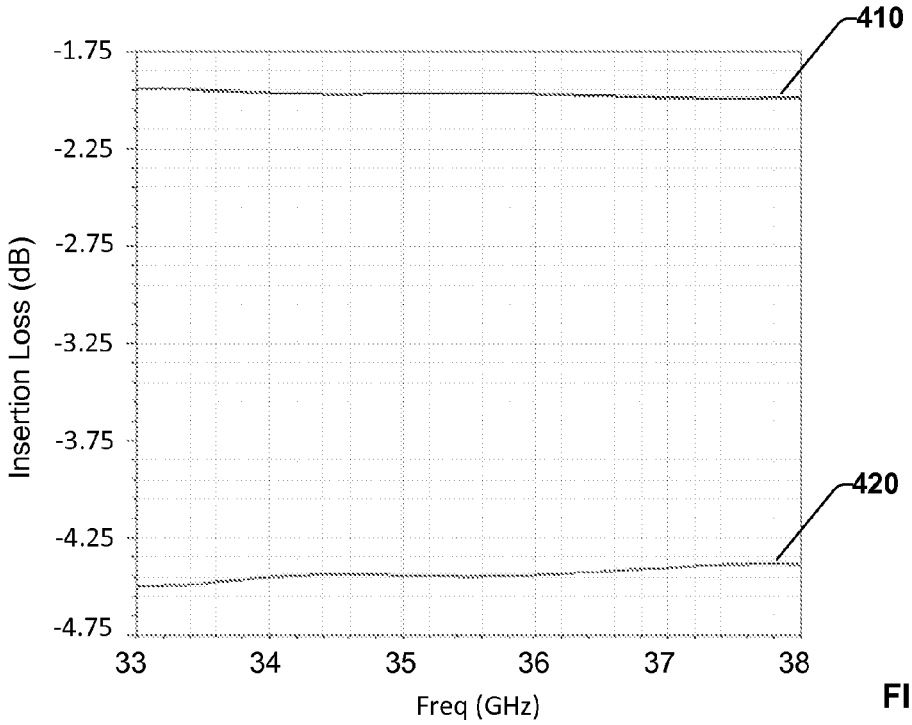
FIG. 4 is a plot of insertion loss as a function of frequency for a waveguide divider.
Figure 5:
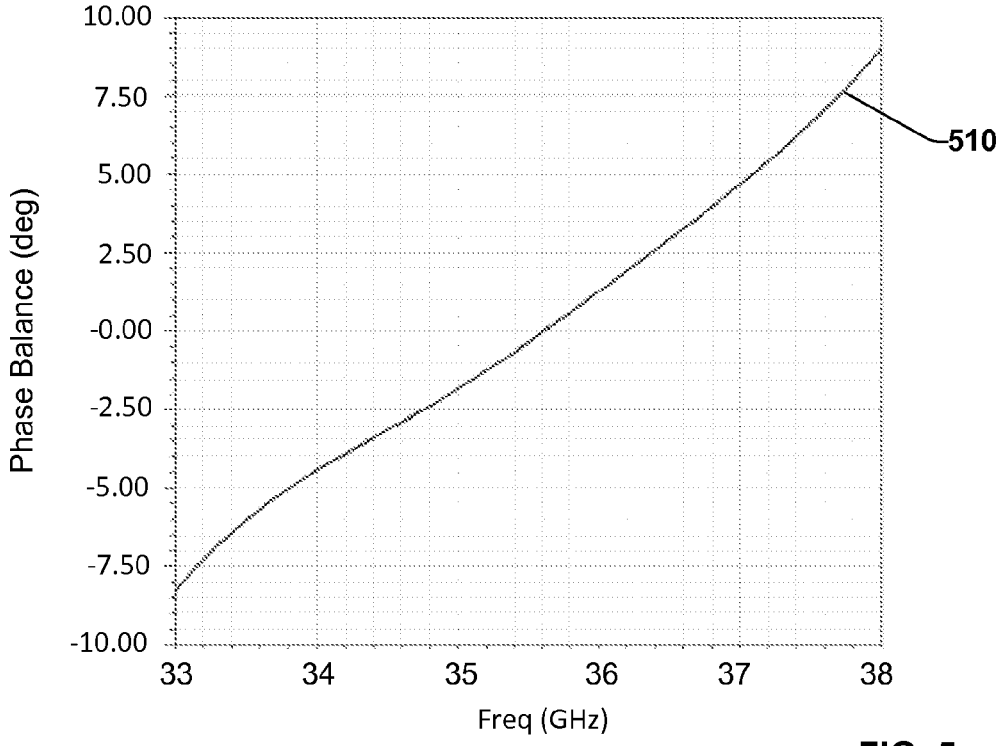
FIG. 5 is a plot of phase balance as a function of frequency for a waveguide divider.

FIGS. 3-5 present performance results for waveguide divider 100, wherein the waveguide divider has a span of 30 mm (e.g., respective lengths of waveguide arms 121 and 131) and distance 111 plus length $L_1$ of septum 150 is 15 mm and is configured to operate as a 64.5:35.5 ratio waveguide divider over a frequency range of 33-38 GHz. It is to be noted that the ports 110, 120 and 130 were de-embedded to remove any effects of small waveguide sections attached to the power splitter design. Accordingly, the "operating" size of the power divider is 11.5 mm×22 mm. With reference to FIG. 1, the 11.5 mm dimension does not include the first input waveguide section, since this is a standard waveguide (de-embedded out). The 22 mm dimension does not span the entire distance between 120 and 130, but rather the de-embedded distance at which a phase for $S_{21}$=a phase for $S_{31}$ and are accordingly tied to RF performance and standard RF design practice (de-embedding).

FIG. 3 is a plot of return loss versus frequency. As shown in FIG. 3, plot 310 indicates input return loss values of about −22.5 dB (at 33 GHz) to about −25 dB (at 38 GHz). A return loss of 10 dB is equivalent to 10% of an input signal returning to the input port. Similarly, a 20 dB and a 30 dB return loss is equivalent to 1% and 0.1% of an input signal returning to the input port, respectively. Accordingly, with return loss values of about −22.5 dB to −25 dB, less than 1% of the input power returns to the input port 110.

FIG. 4 is a plot of insertion loss versus frequency. FIG. 4 presents plots 410 and 420, whereby plot 410 depicts an insertion loss for the output port 130, and plot 420 depicts an insertion loss for the output port 120. The insertion loss for the output port 130 is about −2 dB, while the insertion loss for the output port 120 is about −4.5 dB. The overall insertion loss for output ports 120 and 130 is within ±0.1 dB of the target 64.5:35.5 power split ratio over a 33-38 GHz range.

FIG. 5 is a plot of phase balance versus frequency, whereby the phase balance is a measure of the phase difference between the phase measured between port 110 and port 120 (also known as angle ($S_{21}$)) versus the phase measured between port 110 and port 130 (also known as angle ($S_{31}$)). FIG. 5 presents plot 510, whereby the phase balance is at about −8° at about 33 GHz, and is at about 8° at about 38 GHz. Hence, the phase balance over the 33-38 GHz range is within ±10° from 0°.

Presenting exemplary results for a waveguide divider constructed in accordance with the various features presented above for waveguide divider 100, a return loss >20 dB, insertion losses within ±0.1 dB of their target values, and a phase balance of ±10° can all be achieved over a 33-38 GHz operating range.

Figure 6:
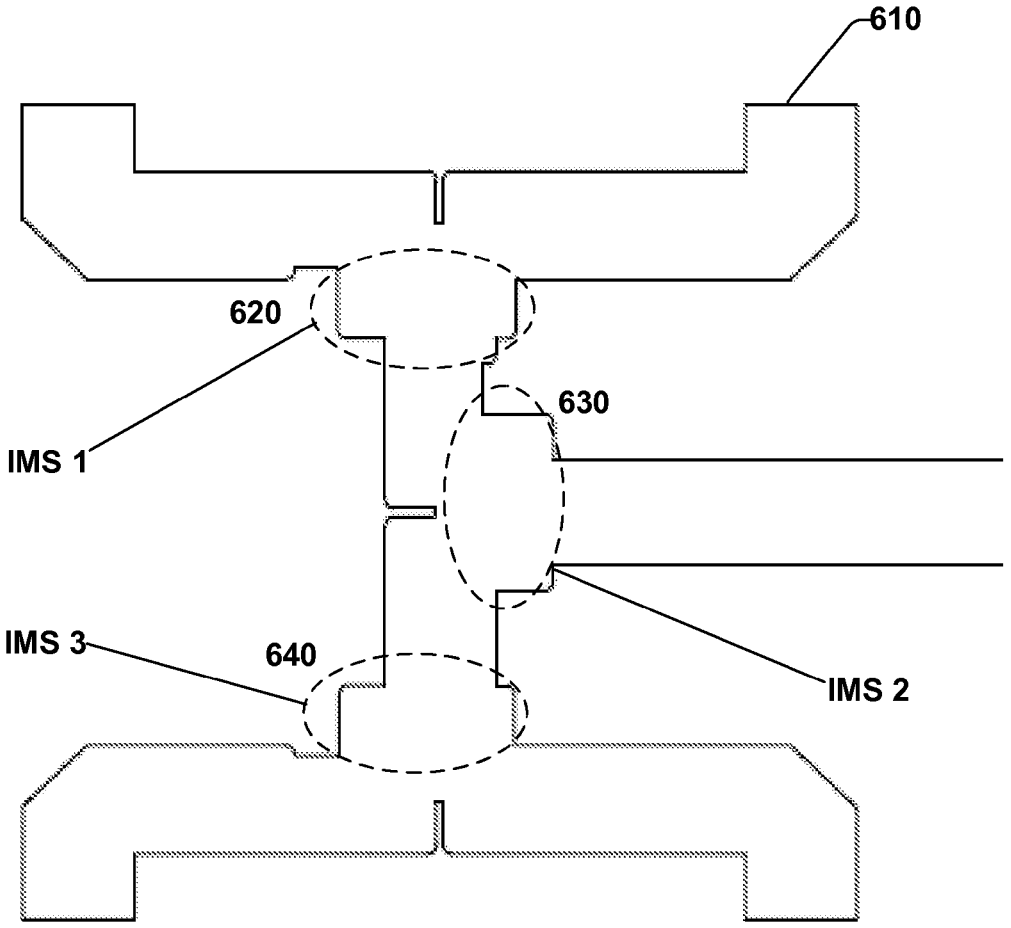
FIG. 6 is a block diagram of a plurality of waveguide dividers.

In an aspect, as illustrated in FIG. 6, incorporation of one or more input match sections (e.g., an input match section 140) into a layout 610 comprising multiple waveguide dividers can result in available space reduction between two adjacent waveguide dividers, where such space reduction can occur over both a length and a width of respective waveguide dividers. Hence, as shown, input match sections IMS 1-3 can take up real estate with regard to size and placement of three waveguide dividers 620, 630, and 640. Accordingly, for example, where space limitations dictate, it may be desirable to form one or more waveguide dividers that are not limited in size by a respective input match section(s).

Figure 7:
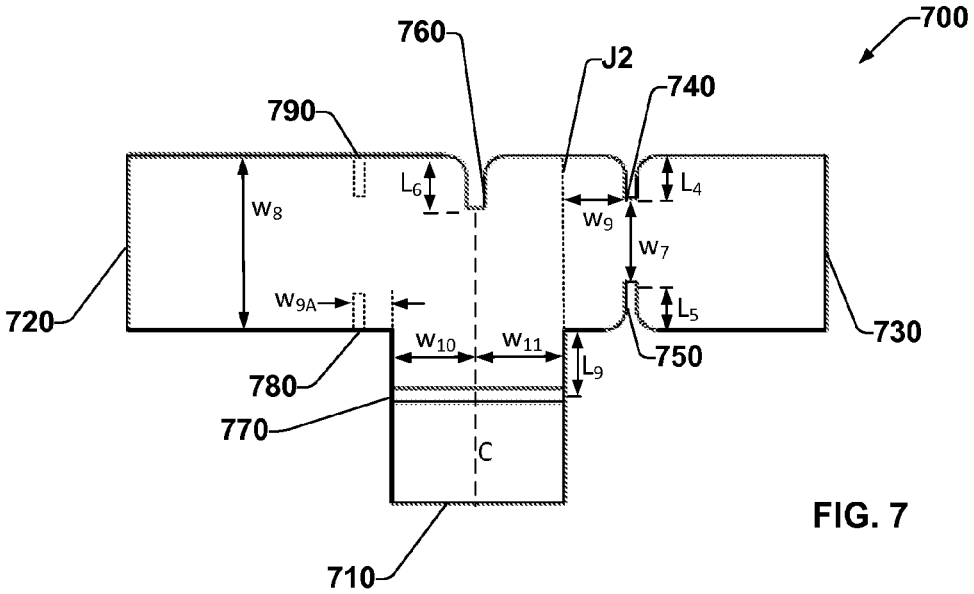
FIG. 7 is a block diagram illustrating a waveguide divider.
Figure 8:
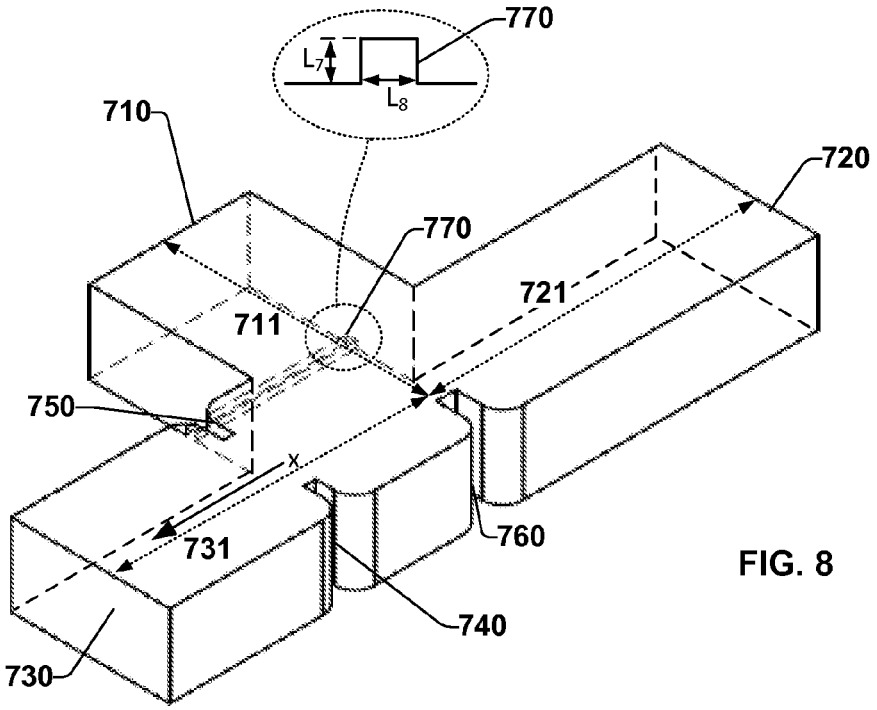
FIG. 8 is a block diagram illustrating a waveguide divider.

Turning to FIGS. 7 and 8, a waveguide divider 700 is illustrated. FIG. 7 is a plan or top view while FIG. 8 is a 3D oblique or perspective view. The waveguide divider comprises two output waveguide arms 721 and 731 that have respective ports 720 and 730. The waveguide divider also includes an input waveguide arm 711 that has an input port 710, wherein the input waveguide arm 711 connects the input port 710 with the two output waveguide ports 720 and 730 of the output waveguide arms 721 and 731, respectively.

Comparing waveguide divider 700 with waveguide divider 100, waveguide divider 700 does not include an input matching section (e.g., as compared with the input matching section 140 of waveguide divider 100) or an iris (e.g., as compared with the iris 160 of design 100). However, waveguide divider 700 utilizes a pair of septums 740 and 750 (also referred to as a pair of resonance septums) to control signaling in the output port 730, whereby septums 740 and 750 can constitute an iris in waveguide arm 731. In another embodiment, a main septum 760 can be incorporated into waveguide divider 700. In a further embodiment, a notch 770 can be incorporated into waveguide divider 700.

The pair of septums 740 and 750 can act to constrict electromagnetic wave propagation to the output port 730 compared with the unconstricted wave propagation which can occur at the output port 720, whereby the constriction can cause signal unbalance between output port 720 and output port 730. For example, the septums 740 and 750 can reduce the width of the waveguide arm 731 to a width $w_7$, in comparison to the width of the waveguide arm 721 being non-constricted at a width $w_8$. The septums 740 and 750 can be placed at a desired distance $w_9$ from a junction of the waveguide arm 731 and the input waveguide arm 711, as indicated by the junction line J2. Further, septums 740 and 750 can have respective lengths $L_4$ and $L_5$, which in conjunction with distance $w_9$ can be utilized to form a waveguide divider 700 having a desired signal unbalance with a high level of bandwidth.

A septum 760 (also referred to as a main septum) can be incorporated into the waveguide divider 700 to divide a signal input via input port 710 and waveguide arm 711, e.g., to achieve unbalanced power division. In an embodiment, the septum 760 can be placed on the centerline c of the input port 710, whereby $w_{10}$ and $w_{11}$ are equal. In another embodiment, the septum 760 can be offset from the centerline c. The septum 760 can be configured with a length of $L_6$.

Further, a notch 770 (also known as a step) can be incorporated into the waveguide divider 700. As shown in FIGS. 7 and 8, the notch 770 can be located in the waveguide arm 711 of the input port 710. In an aspect, the notch 770 can be utilized to tune out an input inductance occurring at a certain distance away from input port 710. The notch 770 can be placed at a location nearest a junction of waveguide arm 711 with respect to waveguide arms 721 and 731, where the input impedance can appear to be inductive, which in comparison with waveguide divider 100, the notch 770 can operate as (e.g., a capacitance notch), and replace, the input match section 140, which allows for a reduction in size of the waveguide divider 700. The notch 770 can have a height of $L_7$, a width of $L_8$, and positioned a distance $L_9$ from the junction of waveguide arm 711 with respect to either of waveguide arms 721 and/or waveguide arms 731. In an embodiment, the position and size of the notch 770 can be selected in accordance with any suitable data, e.g., a Smith chart. Accordingly, the size and the location of the notch 770 can be selected to define an operational frequency (e.g., a central frequency) of the waveguide divider 700.

With regard to design of a waveguide divider which includes a pair of resonance septums (also referred to as a septum divider, e.g., waveguide divider 700) in comparison with a waveguide divider which utilizes an input matching section (also referred to as an input match divider, e.g., waveguide divider 100), a number of benefits can be derived. As previously mentioned, an aspect of the input match divider is one or more interactions can occur at the waveguide junction (e.g., J1) and the input matching section (e.g., input matching section 140). For example, an interaction can occur as a function of the width of the input matching section. Accordingly, with an input match divider, adjusting one design parameter can lead to a plurality of other performance requirements being affected at the same time. For example, adjustment of a power division in an input match divider can be controlled by offsetting the input matching section (e.g., adjusting widths $w_3$ and $w_4$ about centerline c) of the input match divider. However, offsetting the input match section to adjust the power division can also result in a change in of any of the return loss of the waveguide divider, the waveguide divider insertion loss, and/or the phase balance for the waveguide divider. Similarly, adjustment of the iris (e.g., iris 160) and/or the septum (e.g., septum 150) can result in accompanying changes in any of the power division, the return loss, the insertion loss, and/or the phase balance of the waveguide divider. In an aspect, the interrelation between the plurality of design parameters can result in a complicated design process.

Removal of the input matching section and/or the iris from a waveguide divider (e.g., per waveguide divider 700) can enable a reduction in the complexity of designing a waveguide divider. In an aspect, the ports 710, 720, and 730 should be the same size and have the same impedance (per the waveguide standard), and accordingly, it is desired that unequal power division is achieved without changing the size or impedance of the ports. Designing with the following features achieves such a requirement. The main septum 760 can operate as an inductive feature and accordingly, can tune out a degree of the capacitative nature of the junction between waveguide arms 711, 721, and 731. The pair of resonance septums 740 and 750 can act as an inductive septum (or inductive iris), whereby the pair of resonance septums 740 and 750 can be placed at a position on the waveguide arm 731 such that an input into output port 730 (e.g., viewing along X into port 730) can appear as a waveguide with a high input impedance at a desired frequency.

FIG. 7 further illustrates the possibility of adding additional irises and capacitive notches on the waveguide arm 721. A second pair of resonance septums (or an inductive iris) can be added, as indicated by the dashed lines 780 and 790. Alternatively, resonance septums 780 and 790 can be replaced or supplemented by the addition of a capacitive notch, e.g., similar to capacitive notch 770. A capacitive notch can generate a lower impedance looking into port 720 from the junction of waveguide arms 711, 721, and 731. In an aspect, a capacitive notch can act similar to the inductive iris formed by the septums 740 and 750 but with an opposite effect. For example, an inductive iris (e.g., formed by septums 740 and 750) plus a line length (e.g., length $w_9$) can form a high impedance line. Similarly, a capacitive notch (e.g., formed by a similar structure as 770) plus a line length (e.g., the length $w_{9A}$) can form a low impedance line. An inductive iris formed from septums 780 and 790 plus a line length (e.g., the length $w_{9A}$) can also form a low impedance line with sufficient distance from the junction of waveguide arms 711, 721, and 731. Similarly, a further capacitive notch (e.g., similar to capacitive notch 770) can be added to the waveguide arm 711 of input 710 to create a lower impedance on the input line (e.g., waveguide 711) of the waveguide divider 700. Further, it is possible to add additional septums, irises, or notches to the waveguide divider 700 to achieve additional bandwidth. In an aspect, the addition of further septums can result in formation of a waveguide divider having a greater footprint than a waveguide divider having fewer septums.

Figure 9:
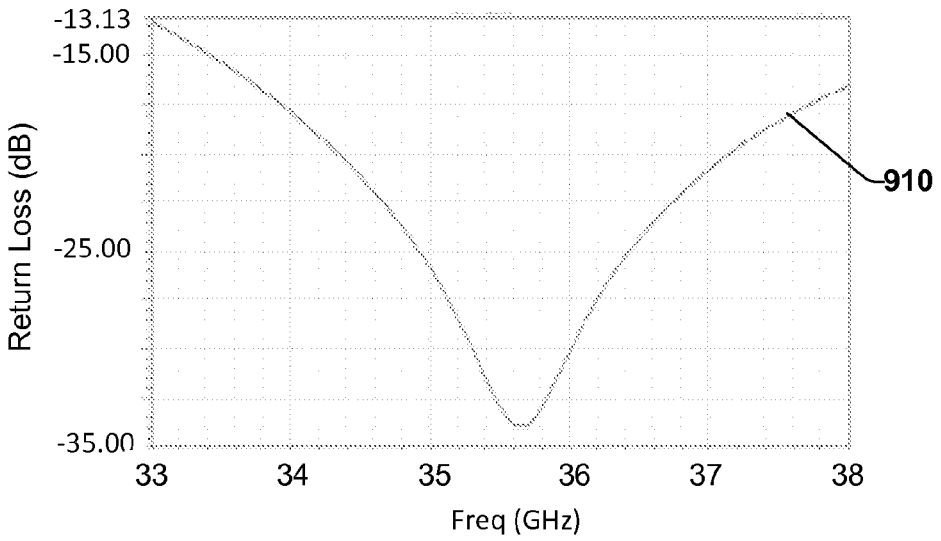
FIG. 9 is a plot of input return loss as a function of frequency for a waveguide divider.
Figure 10:
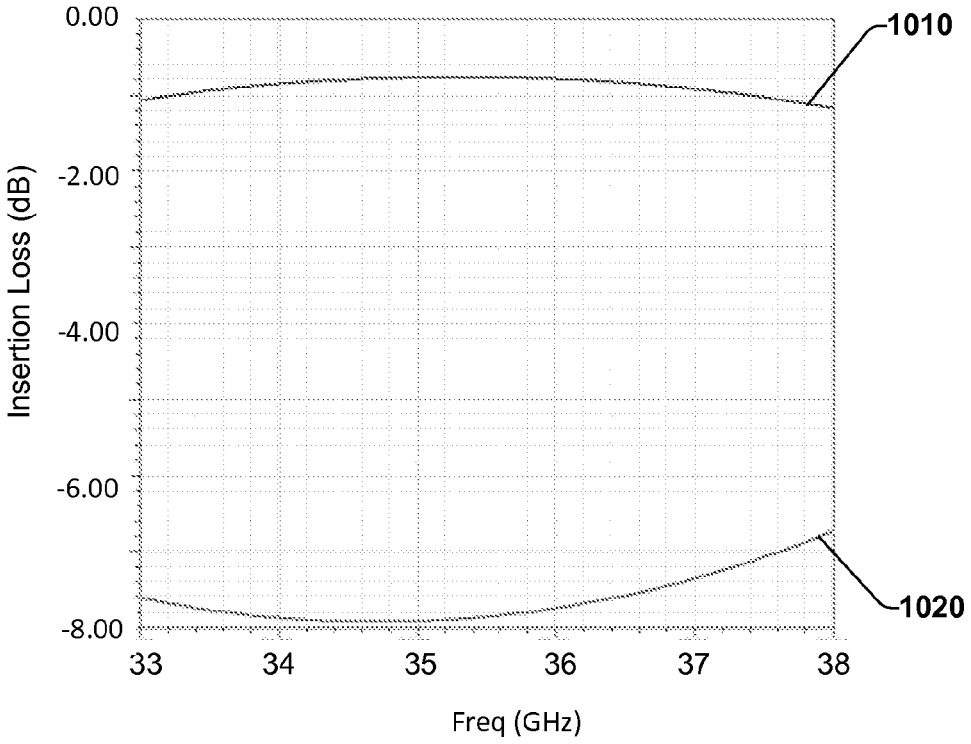
FIG. 10 is a plot of insertion loss as a function of frequency for a waveguide divider.
Figure 11:
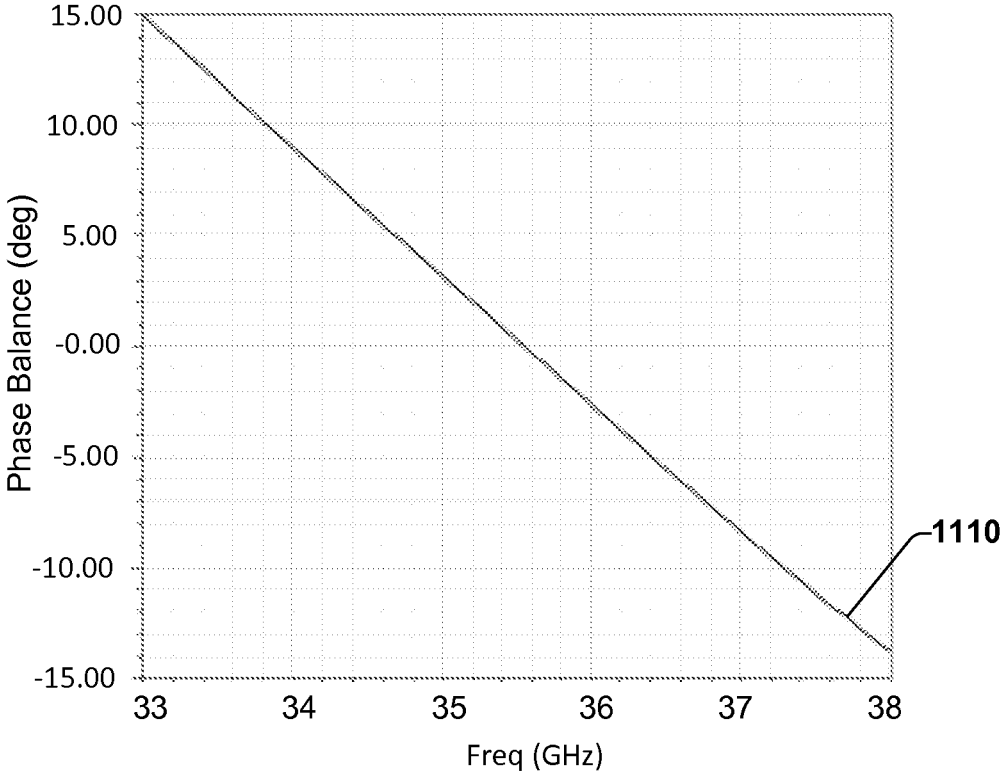
FIG. 11 is a plot of phase balance as a function of frequency for a waveguide divider.

FIGS. 9-11 present performance results for waveguide divider 700, wherein the waveguide divider has a span of 30 mm (e.g., respective lengths of waveguide arms 721 and 731) and distance 711 plus length $L_6$ of septum 760 is 15 mm and is configured to operate as a 83.1:16.9 ratio waveguide divider over a frequency range of 33-38 GHz. It is to be noted that the ports 710, 720 and 730 were de-embedded to remove any effects of small waveguide sections attached to the power splitter design. Accordingly, the "operating" size of the power divider is 10.6 mm×15.75 mm. With reference to FIG. 7, the 10.6 mm dimension does not include some of the first input waveguide section, since this is a standard waveguide (de-embedded out). Further, the 15.75 mm dimension does not span the entire distance between 720 and 730, but rather the de-embedded distance at which a phase for $S_{21}$=a phase for $S_{31}$ and are accordingly tied to RF performance and standard RF design practice (de-embedding).

FIG. 9 presents a plot of return loss as a function of frequency. As shown in FIG. 9, plot 910 indicates the input return loss over the 33-38 GHz range, with input return loss values of about −13.5 dB (at 33 GHz), to about −34 dB (at about 35.7 GHz) to about −16.5 dB (at 38 GHz).

FIG. 10 presents respective plots of insertion loss as a function of frequency. As shown in FIG. 10, plot 1010 depicts an insertion loss for the second port 720, and plot 1020 depicts an insertion loss for the third port 730. The insertion loss for port 720 is about −0.8 to −1.2 dB, while the insertion loss for the port 730 is about −7.6 dB (at 33 GHz), to about −7.9 dB (at 34.7 GHz), to about −6.7 dB (at 38 GHz). In an aspect, the overall insertion loss for port 720 is within ±0.4 dB over a 33-38 GHz range and is within ±1.0 dB over a 33-38 GHz range for port 730.

FIG. 11 presents a plot of phase balance as a function of frequency. As shown in FIG. 11, a plot 1110 of phase balance indicates the phase is at about 15° at about 33 GHz, and is at about −13.8 at about 38 GHz. Hence, the phase balance over the 33-38 GHz range is ±15° about 0°.

Presenting exemplary results for a waveguide divider constructed in accordance with the various features presented above for waveguide divider 700, a return loss >13.5 dB, insertion losses within ±1.0 dB or better from their target values, and a phase balance of ±15° can all be achieved over a 33-38 GHz operating range. It is to be appreciated that when comparing values presented in FIGS. 10-12 with values presented in FIGS. 3-5, the degree of unbalance is less for waveguide divider 100 (e.g., 64.5:35.5) than the waveguide divider 700 (83.1:16.9). It is to be further appreciated that if the frequency band of operation was reduced (or narrowed) then a waveguide divider having a smaller dimensional size (e.g., footprint) can be fabricated.

Figure 12:
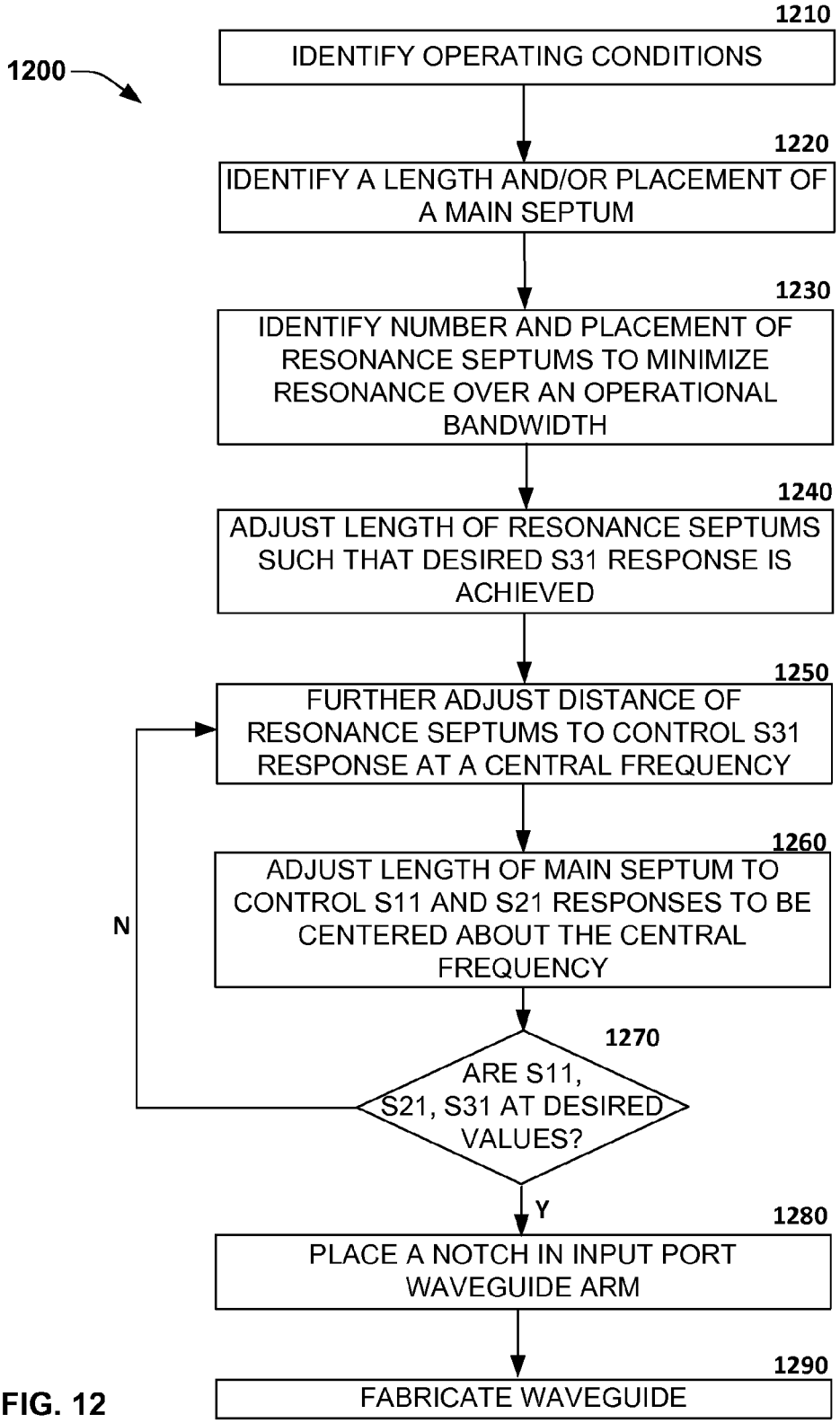
FIG. 12 is a flow diagram illustrating an exemplary methodology for designing and fabricating a waveguide divider.
Figure 20:
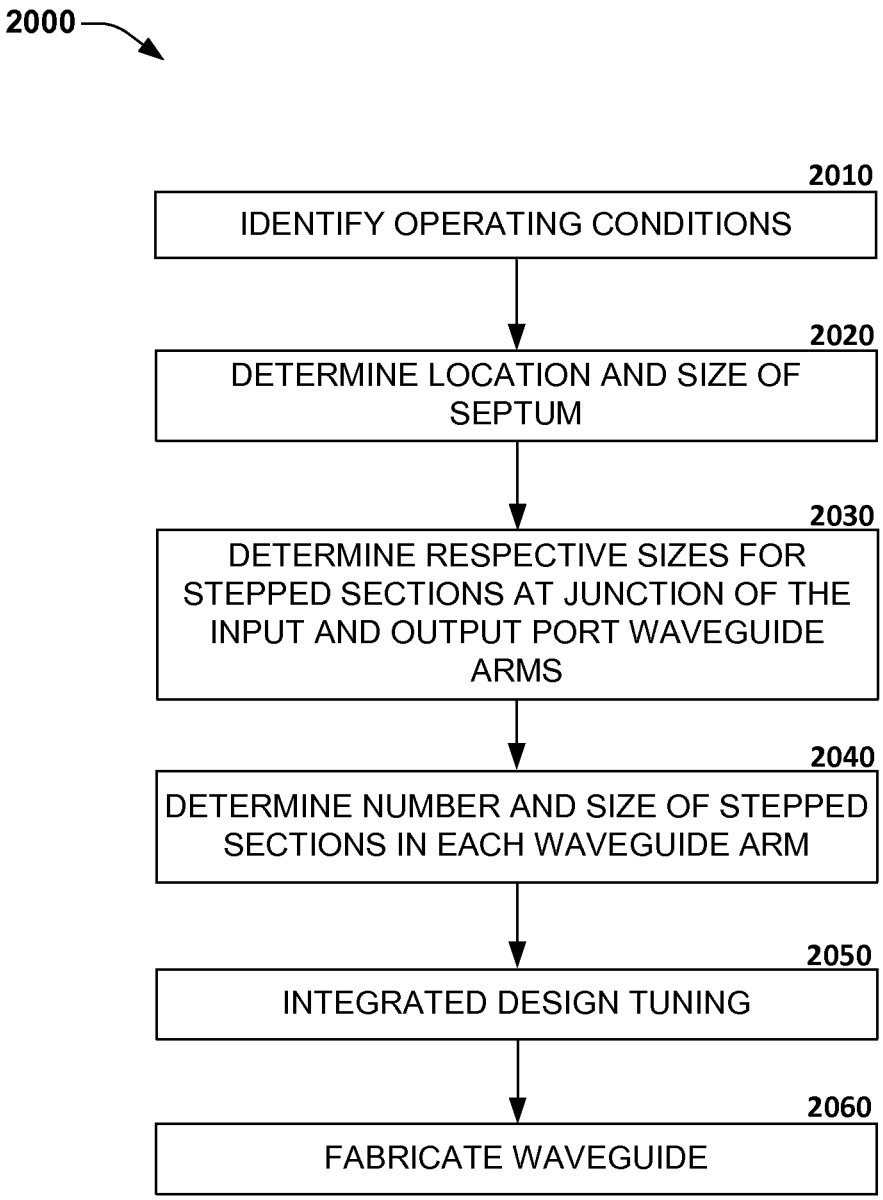
FIG. 20 is a flow diagram illustrating an exemplary methodology for designing and fabricating a waveguide divider.

FIGS. 12 and 20 illustrate exemplary methodologies relating to waveguide divider design. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement the methodologies described herein.

FIG. 12 presents an exemplary methodology 1200 for constructing a waveguide divider. The waveguide divider can comprise of an input port, a first output port and a second output port. In an embodiment, the waveguide divider can have a "T" configuration. At 1210, operating conditions for the waveguide divider can be identified. For example, the operating frequency of the waveguide divider, and an associated impedance, can be defined in accordance with a waveguide standard to enable incorporation of the waveguide divider into a system to minimize insertion losses, etc., while maximizing operational bandwidth and frequency range. Some example operating conditions would be the operating frequency range of the divider, target return loss, target insertion loss, and target phase balance. In an aspect, the waveguide standard can be WR-28, as previously mentioned. In another aspect, as previously mentioned, various dimensions for the waveguide divider, e.g., dimensions for the input and output ports can be of a customizable size with regard to height and width.

At 1220, a length and placement for a main septum to be located in the waveguide divider can be determined. As previously mentioned, the main septum can be placed opposite and centrally with respect to the input port to divide a signal being input into the waveguide divider via the input port. In an aspect, central placement of the main septum with respect to the input port can separate the input signal into two signals of equal strength.

At 1230, a distance can be identified at which a pair of septums (e.g., a pair of resonance septums) can be placed on the arm of the second output port. The distance can be determined based upon minimization of one or more resonances which may occur over a desired bandwidth of operation (e.g., 33-38 GHz).

At 1240, the length of the respective septums in the pair of septums can be adjusted to enable a desired response being achieved. For example, with reference to the second output port, a response $|S_{31}|$ can be achieved. In an aspect, the septums can cause a "throttling" of signaling passing through, and accordingly, the septums can be utilized to control the power split between the first output and the second output.

At 1250, the location of the pair of septums with respect to a junction of the second arm to the arm of the input port can be adjusted. Adjusting the location of the pair of septums can further adjust the $|S_{31}|$ response. For example, the $|S_{31}|$ response can be further tailored to a desired operational frequency (e.g., a central frequency in the operational range of 33-38 GHz).

At 1260, the length of the main septum can be adjusted to engender an adjustment in a response at the input port (e.g., $|S_{11}|$), and also adjustment in a response at the second port (e.g., $|S_{21}|$). For example, adjusting responses $|S_{11}|$ and $|S_{21}|$ such that they are at the central frequency.

The respective adjustment of the length of the main septum at 1250 (e.g., an associated adjustment of the responses $|S_{11}|$ and $|S_{21}|$) can cause an adjustment in the $|S_{31}|$ response. At 1270, a determination can be made as to whether the respective responses, $|S_{11}|$, $|S_{21}|$ and/or $|S_{31}|$ are at a desired value, for example, a central value in the frequency range of 33-38 GHz. In response to a determination that the any of $|S_{11}|$, $|S_{21}|$ and/or $|S_{31}|$ are not at a desired value, the methodology can return to steps 1240 and 1250 as required to adjust the $|S_{11}|$, $|S_{21}|$ and/or $|S_{31}|$ responses.

At 1280, in response to a determination at 1270 that the $|S_{11}|$, $|S_{21}|$ and/or $|S_{31}|$ responses are at a desired value, the input port can be de-embedded. Further, optimization of $|S_{11}|$ may be achieved by incorporating a capacitive notch into the arm of the input port. The location and size of the capacitive notch can further adjust the frequency of operation of the waveguide divider to a desired frequency of operation.

Turning to FIGS. 13-17, a waveguide divider 1300 is illustrated. The waveguide divider 1300 comprises two output waveguide arms 1321 and 1331 that have respective ports 1320 and 1330. The waveguide divider 1300 also includes an input waveguide arm 1311 that has an input port 1310, wherein the input waveguide arm 1311 connects the input port 1310 with the two output waveguide ports 1320 and 1330 of the output waveguide arms 1321 and 1331, respectively. In comparison with waveguide dividers 100 and 700, the respective arms of waveguide divider 1300 have stepped profiles or transformers. In an aspect, utilizing stepped profiles can enable operation of the design 1300 at a wide bandwidth and/or frequency range.

Figure 13:
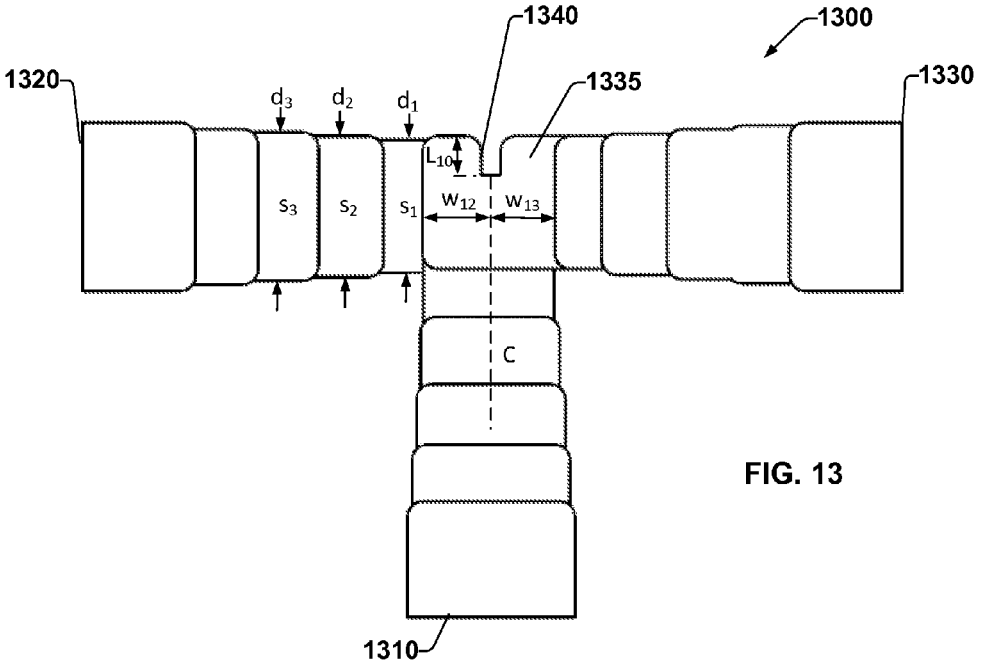
FIG. 13 is a block diagram illustrating a waveguide divider.
Figure 14:
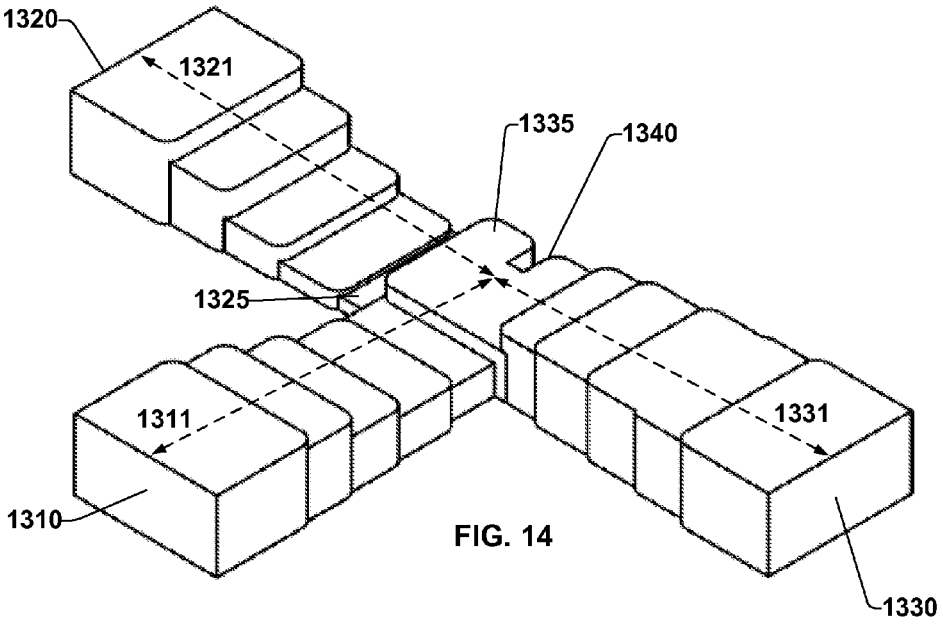
FIG. 14 is a block diagram illustrating a waveguide divider.
Figure 15:
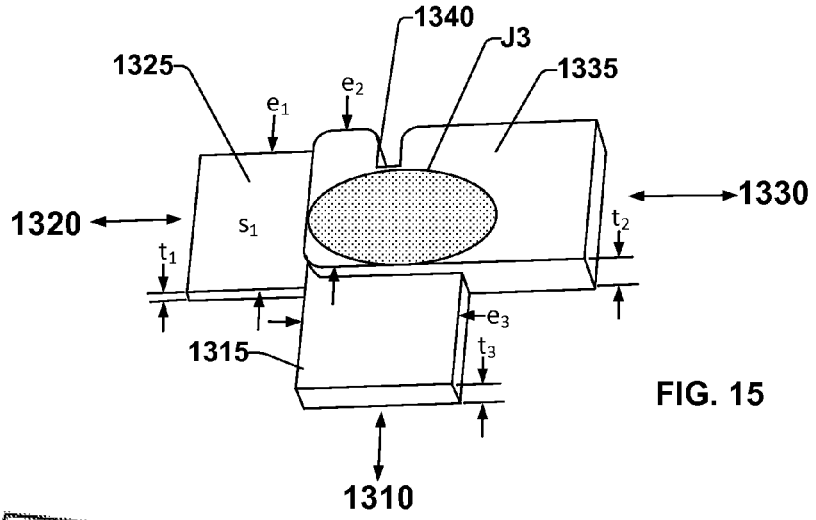
FIG. 15 is a block diagram illustrating a waveguide divider.
Figure 16:
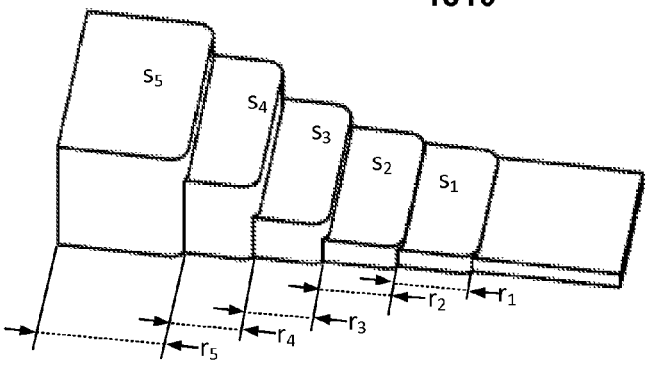
FIG. 16 is a block diagram illustrating a waveguide divider.
Figure 17:
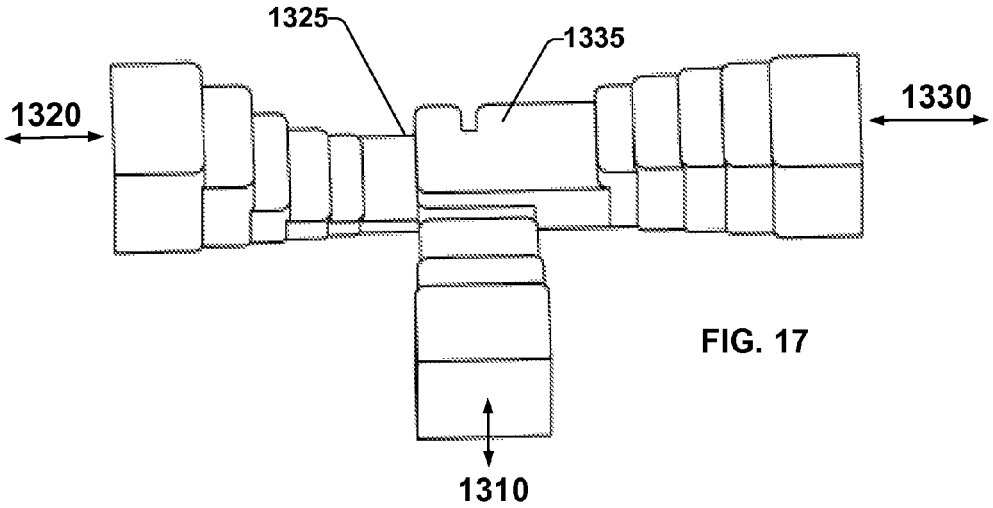
FIG. 17 is a block diagram illustrating a waveguide divider.

FIG. 13 is a plan view or top view, FIG. 14 is an oblique 3D view or a perspective view, FIG. 15 illustrates the junction of a portion of the waveguide arm 1311, a portion of the waveguide arm 1321, and a portion of the waveguide arm 1331. FIG. 16 illustrates one of a portion of either of the waveguide arms 1311, 1321 or 1331. FIG. 17 illustrates the junction of a portion of the waveguide arm 1311, a portion of the waveguide arm 1321, and a portion of the waveguide arm 1331, facilitating viewing of the initial step in the stepped profile being bigger for the waveguide arm 1331 compared with the waveguide arm 1321. In an aspect, the respective sizes of the ports 1310, 1320, and 1330 can be based upon a waveguide standard (e.g., WR-28, as previously described). Accordingly, the stepped profiles of the respective arms can be stepped to obtain the desired WR-28 dimensions (e.g., 7.112 mm×3.556 mm) at ports 1310, 1320 and 1330 and also a characteristic impedance for the standard, e.g., to enable insertion of the various waveguide divider configurations presented herein into standard systems.

Waveguide divider 1300 can include a main septum 1340 that can be placed opposite the input port 1310, e.g., $W_{12}$ and $W_{13}$ about centerline c. As shown in FIGS. 13-17, a signal unbalance can be provided by creating a disparity between the size and number of transformer regions $s_1$-$s_n$ in the respective waveguide arms 1321 and 1331. As shown in FIG. 15, a stepped region 1335 can have a greater thickness $t_2$, and accordingly, a greater volume, in relation to the thickness $t_1$ of a stepped region 1325. The stepped region 1335 is an initial step in the waveguide arm 1331, while the stepped region 1325 is an initial step in the waveguide arm 1321. In an embodiment, thicknesses $t_1$ and $t_2$ can be determined with respect to the thickness $t_3$ of the input step 1315 of the input port 1310. As shown in FIG. 15, $t_1<t_3<t_2$. It is to be appreciated that any relation between $t_1$, $t_2$, and $t_3$ can exist as required to create a desired imbalance between the output port 1320 and the output port 1330 relative to the incoming signal from input port 1310. For example, $t_1$, $t_2$, and/or $t_3$ can have values that are equal or disparate to one another. In an aspect, by adjusting the respective thicknesses $t_1$, $t_2$, $t_3$, the waveguide divider can be considered to be being performed in both the H-plane and the E-plane.

As further shown in FIGS. 13-17, as well as the respective waveguide arms 1311, 1321, and 1331, having a stepped profile, the width of each step can be sized to be larger than a preceding step (e.g., for the waveguide arms 1321 and 1331), and smaller than a preceding step (e.g., for the waveguide arm 1311). For example, as shown on FIG. 13, a first step $s_1$ located adjacent to a junction of the waveguide arm 1311 and the waveguide arm 1321 can have a width $d_1$. The next adjacent step, $s_2$, in the waveguide arm 1321 can have a width $d_2$, while the next adjacent step, $s_3$, can have a width $d_3$. As shown, as the waveguide arm 1321 is traversed each step can have a larger width than the previous step, e.g., $d_1<d_2<d_3$. Accordingly, as shown in FIG. 13, in combination with FIG. 15, as the waveguide arm 1321 is traversed, the volume of each step can increase as a function of the width (d) and the thickness (t) for each particular step. Viewing FIGS. 15-17, a design flow to form a 3D stepped waveguide divider (e.g., waveguide divider 1300), as further described below, can comprise of initially designing a junction region J3 of the "T" formed by the waveguide arm 1321, the waveguide arm 1331 and the waveguide arm 1311. FIG. 15 illustrates an initial step in the design of the junction region J3 of waveguide divider 1300. As shown, unbalance can be created by a difference in size of the initial step 1335 forming waveguide arm 1331 and the initial step 1325 forming waveguide arm 1321 in relation to the size of the step 1315 of the input waveguide arm 1311.

Further, as shown in FIG. 15, the respective steps forming the junction J3 can have different widths. For example, step 1325 can have a width $e_1$, step 1335 can have a width $e_2$, and step 1315 can have a width $e_3$, where each of the widths can be of a different width to another width or of the same width as another width. Furthermore, while not shown in FIG. 15, the respective length of each step 1315, 1325, and 1335 can also be of any respectively desired dimension. Accordingly, the respective steps 1315, 1325, and 1335 can be sized to facilitate a respective required size with regard to thickness and width.

Furthermore, a profile for each of the waveguide arms 1311, 1321, and 1331 can be determined. As previously mentioned, to satisfy a waveguide standard, the size and impedance of the ports 1310, 1320, and 1330 are configured in accordance with the waveguide standard. Hence, with the size of the ports 1310, 1320, and 1330 being known (e.g., per WR-28, port dimensions are 7.112 mm×3.556 mm), each waveguide arm can have stepped portions/transformers defined such that a profile of each waveguide arm steps from the size of the initial step (e.g., steps 1325 and 1335) or the final step (e.g., step 1315) along the length of the respective waveguide to the location and size of the respective port (e.g., ports 1310, 1320, and 1330). With regard to designing the profile for each waveguide arm, the stepped transformers are required to transition from one waveguide cross-section to another waveguide cross-section (e.g., $s_1 \rightarrow s_2 \rightarrow s_3 \rightarrow s_4 \rightarrow s_5$). The stepped regions $s_1$-$s_n$ can have respective lengths $r_1$-$r_n$, per FIG. 16. As shown in FIGS. 13-17, the transformers can be binomial to achieve wide bandwidth operation while engendering low ripple effects. Other transformer configurations can be utilized such as Chebyshev, Klopfenstein, etc.

A subsequent design stage, as shown in FIG. 17, can involve the integration of the respective waveguides as determined in conjunction with FIGS. 15 and 16 to achieve final design of the waveguide divider 1300.

With regard to designing the junction J3 and also the various transformers, with reference to FIG. 15, equation 1 defines the impedance of a TE10 mode in an air-filled waveguide:

$$Z_0 \approx \frac{4\pi f \mu_0 b}{a\sqrt{(2\pi f)^2 \mu_0 \varepsilon_0 - \left(\frac{\pi}{a}\right)^2}} \qquad \text{Eqn. 2}$$

where $Z_0$ is the desired characteristic impedance, f is the frequency, a is the waveguide width (e.g., any of $d_1$, $d_2$, or $d_3$ . . . ), b is the waveguide height (e.g., any of respective $t_1$, $t_2$, or $t_3$ . . . ), $\mu_0$ is the free space permeability, and $\epsilon_0$ is the free space permittivity. In an aspect, waveguide height, b, can have a greater effect on impedance than waveguide width, a. As previously mentioned, $Z_0$ can be based on a waveguide standard, for example WR-28. Further, $Z_0$ can relate to the impedance of an input/output port, as well as an impedance for a particular stepped transformer in a waveguide arm.

Figure 18:
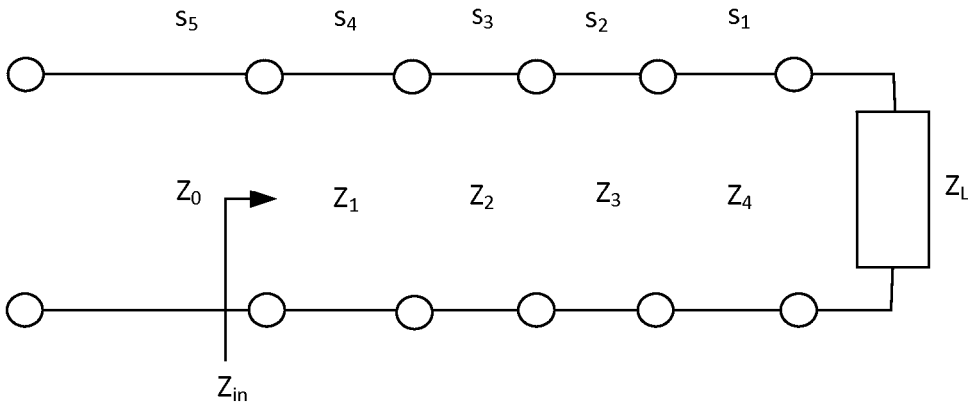
FIG. 18 is a schematic of respective impedance for a plurality of stepped transformers.
Figure 19:
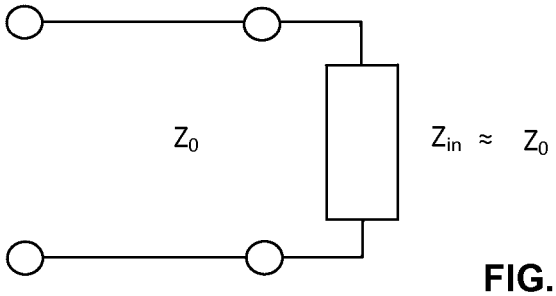
FIG. 19 is a schematic depicting an equivalent input impedance of a plurality of stepped transformers.

As shown in FIGS. 18 and 19, the respective stepped sections, $s_1$, $s_2$, $s_3$, $s_4$, and $s_5$, can be tuned (e.g., as a function of height, width, and/or length) to mitigate and/or minimize any undesired effects such as waveguide transition effects, waveguide capacitive effects, etc. In an aspect, the undesired effects can be parasitic in nature and hence reduce the operational efficiency of a waveguide divider. As shown in FIGS. 18 and 19, respective impedances $Z_1$-$Z_4$ can be obtained for each respective step $S_4$-$S_1$, with $Z_0$ being obtained at step $S_5$. In an aspect, the impedance $Z_L$, when looking into the waveguide structure can be of a magnitude $Z_0$, which can be achieved based upon a design (e.g., height, width and length) of the transformer sections $s_1$-$s_4$, per the example in FIG. 18.

Accordingly, waveguide divider 1300 enables high RF performance over a wide bandwidth. Adjustment of size and RF performance of waveguide divider 1300 can be achieved by addition or removal of one or more transformers (e.g., any of stepped sections $s_1$, $s_2$, $s_3$, $s_4$, and $s_5$). Feature influences on the s-parameter responses (e.g., any of $|S_{11}|$, $|S_{21}|$ and/or $|S_{31}|$) of the respective waveguide arms of waveguide divider 1300 are well understood, whereby such features can be changed relatively independently of each other. Accordingly, owing to the feature independence and knowledge of how such feature change can affect RF performance waveguide dividers can be efficiently designed and fabricated.

FIG. 20 presents an exemplary methodology 2000 for constructing a waveguide divider. The waveguide divider can comprise of an input port, a first output port and a second output port, whereby the respective waveguide arms can comprise of stepped transformer regions. In an embodiment, the waveguide divider can have a "T" configuration. At 2010, operating conditions for the waveguide divider can be identified. For example, the operating frequency of the waveguide divider, and an associated impedance, can be defined in accordance with a waveguide standard to enable incorporation of the waveguide divider into a system to minimize insertion losses, etc., while maximizing operational bandwidth and frequency range. Some example operating conditions would be the operating frequency range of the divider, target return loss, target insertion loss, and target phase balance. In an aspect, the waveguide standard can be WR-28, as previously mentioned. In another aspect, as previously mentioned, various dimensions for the waveguide divider, e.g., dimensions for the input and output ports can be of a customizable size with regard to height and width.

At 2020, a size and location of a septum can be determined, whereby the size and location can enable unbalanced dividing of an RF signal by the waveguide divider.

At 2030, the respective dimensions of stepped transformers at the junction of the input waveguide arm and the two output waveguide arms can be determined. In an aspect, divide the input signal in an unbalanced manner between the two output waveguide arms, a stepped transformer forming a first stepped region in a first output waveguide can have a greater thickness than the thickness of a stepped transformer forming a first stepped region in a second output waveguide.

At 2040, for each waveguide arm a number and size of stepped transformers can be determined to form each waveguide from its initial step at the junction through to the respective output and input ports. As previously mentioned, compliance with a waveguide standard requires the respective output and input ports to be of a particular size and impedance. Accordingly, by utilizing a sequence of stepped transformers, each waveguide arm can transition from an initial dimension and impedance at the waveguide junction to a final dimension and impedance at the respective port.

At 2050, final tuning can be performed whereby the determined septum (e.g., width, length, placement), the respective transformers at the junction, the respective transformers in each waveguide arm, and the final desired port dimensions, etc., can be integrated into a single design. Tuning can comprise of tuning dimensions of respective stepped transformers, and any other dimension comprising a waveguide divider.

At 2060, a waveguide divider can be fabricated which combines the determined septum, the respective transformers at the junction, the respective transformers in each waveguide arm, and the final desired port dimensions.

FIGS. 21-25 present performance results for waveguide divider 1300 (e.g., as presented in FIG. 17), wherein the waveguide divider has a span of 41.4 mm (e.g., respective lengths of waveguide arms 1321 and 1331) and distance 1311 plus length $L_{10}$ of septum 1340 is 16.5 mm and is configured to operate as a 25:75 ratio waveguide divider over a frequency range of 33-38 GHz. It is to be noted that the ports 1310, 1320 and 1330 were de-embedded to remove any effects of small waveguide sections attached to the power splitter design. Accordingly, the "operating" size of the power divider is 11.5 mm×40.87 mm. With reference to FIG. 13, the 11.5 mm dimension does not include the first input waveguide section, since this is a standard waveguide (de-embedded out). Further, the 40.87 mm dimension does not span the entire distance between 1320 and 1330, but rather the de-embedded distance at which a phase for $S_{21}$=a phase for $S_{31}$ and are accordingly tied to RF performance and standard RF design practice (de-embedding).

Figure 21:
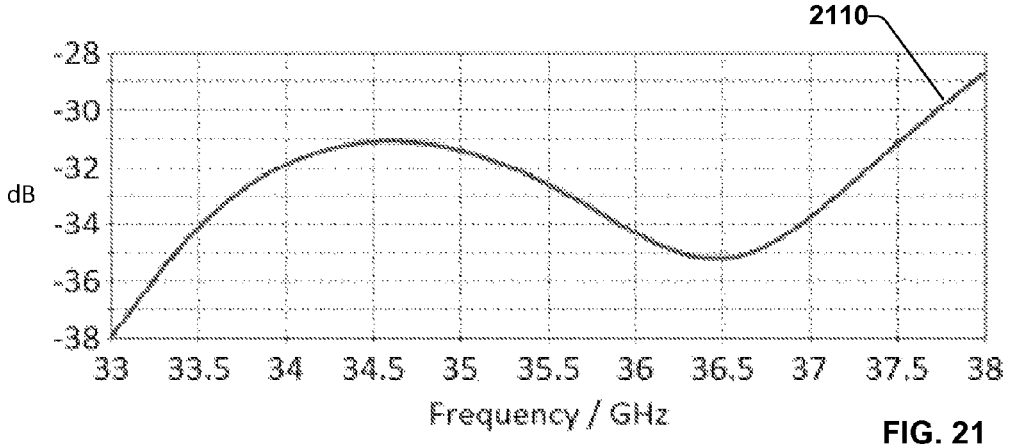
FIG. 21 a plot of input return loss as a function of frequency for a waveguide divider.

FIG. 21 presents a plot of return loss (e.g., S-parameter $|S_{11}|$) as a function of frequency. As shown in FIG. 21, plot 2110 indicates the input return loss over the 33-38 GHz range, with $|S_{11}|$ value of about −38 dB (at 33 GHz), to about −29 dB (at about 38 GHz).

Figure 22:
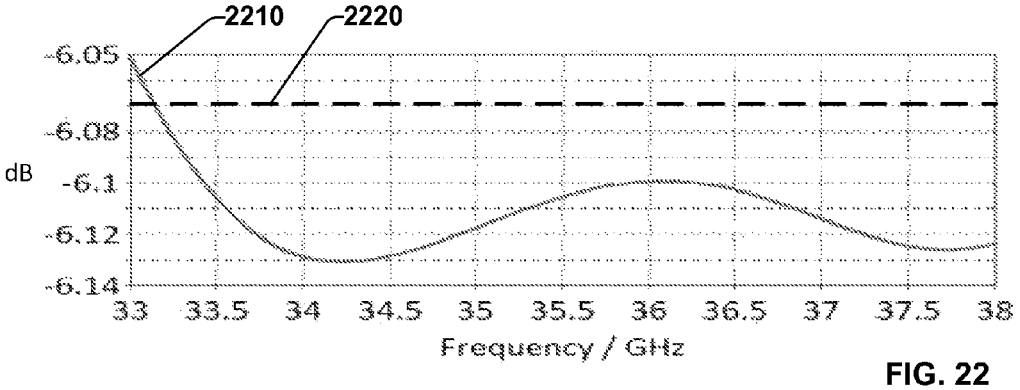
FIG. 22 a plot of insertion loss as a function of frequency for a first output waveguide arm in a waveguide divider.

FIG. 22 presents a plot of insertion loss for a first output waveguide arm (e.g., S-parameter $|S_{21}|$) as a function of frequency. As shown in FIG. 22, plot 2210 indicates insertion loss for $|S_{21}|$ over the 33-38 GHz range, with an insertion loss of about −6.05 dB (at 33 GHz), to about −6.125 dB (at about 38 GHz). The waveguide divider 1300 was configured with a target value 2220 of −6.070 dB, and as shown a maximum deviation of 0.061 dB was achieved.

Figure 23:
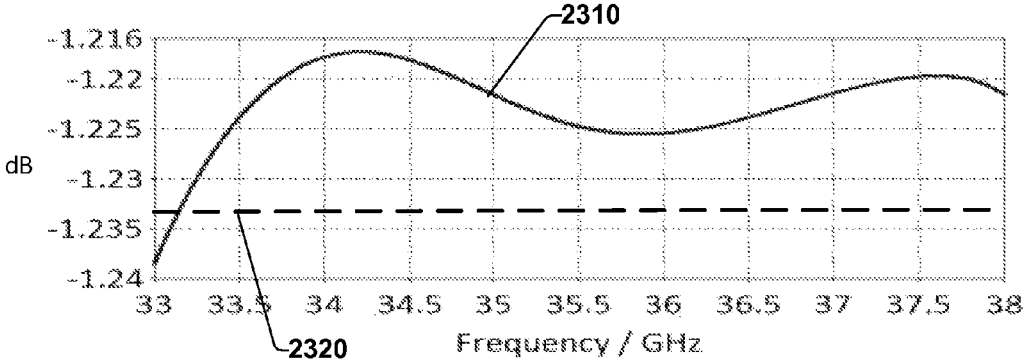
FIG. 23 a plot of insertion loss as a function of frequency for a second output waveguide arm in a waveguide divider.

FIG. 23 presents a plot of insertion loss for a second output waveguide arm (e.g., S-parameter $|S_{31}|$) as a function of frequency. As shown in FIG. 23, plot 2310 indicates insertion loss for $|S_{31}|$ over the 33-38 GHz range, with an insertion loss of about −1.24 dB (at 33 GHz), to about −1.22 dB (at about 38 GHz). The waveguide divider 1300 was configured with a target value of −1.233 dB, and as shown a maximum deviation of 0.016 dB was achieved.

Figure 24:
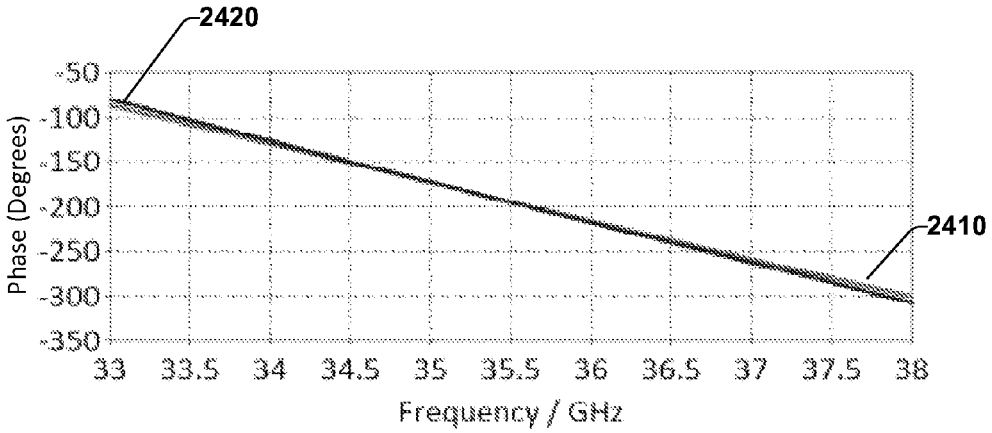
FIG. 24 a plot of phase balance as a function of frequency for a waveguide divider.

FIG. 24 presents phase balance plots for S-parameters $S_{21}$ and $S_{31}$ as a function of frequency. As shown in FIG. 24, plot 2410 indicates the phase for $S_{21}$ and plot 2420 indicates the phase $S_{31}$ over the 33-38 GHz range, with both S-parameters having a phase of about −85° (at 33 GHz) to a phase of about −300° (at about 38 GHz), and are accordingly, closely matched.

Figure 25:
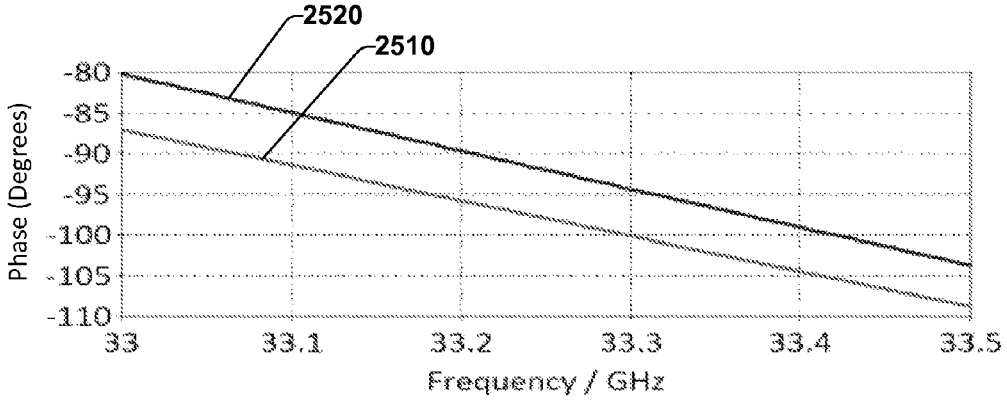
FIG. 25 is a zoomed portion of FIG. 24, presenting a plot of phase balance as a function of frequency for a waveguide divider.

FIG. 25 presents phase balance plots for S-parameters $S_{21}$ and $S_{31}$ as a function of frequency, whereby FIG. 25 is a zoomed region of FIG. 24 between 33-33.5 GHz. As shown in FIG. 25, plot 2510 indicates the phase for $S_{21}$ and plot 2520 indicates the phase $S_{31}$ over the 33-33.5 GHz range, with $S_{21}$ having a phase of about −87° (at 33 GHz) to a phase of about −109° (at about 33.5 GHz) and $S_{31}$ having a phase of about −80° (at 33 GHz) to a phase of about −104° (at about 33.5 GHz). Accordingly, FIG. 24 and FIG. 25 depict a phase balance of ±6.81° between $S_{21}$ and $S_{31}$.

It is to be appreciated that while the foregoing embodiments are presented with regard to application as a waveguide power divider, the same embodiments can also be directed towards waveguide power combiner applications. Hence, the various dividers structures 100, 700 and 1300 can be considered to be a respective waveguide divider-combiner. Accordingly, while respective ports 120, 130, 720, 730, 1320 and 1330 are presented as being output ports (with associated waveguide arms), when utilized as a waveguide power combiner, the respective ports can function as input ports. Similarly, when presented as a waveguide power combiner, any of respective ports 110, 710, and 1310 can operate as output ports. Hence, with reference to FIG. 13, when waveguide divider 1300 operates as a waveguide combiner, a first signal can be input at port 1320 and a second signal can be input at 1330, the first signal and second signal can combine at the stepped regions 1325 and 1335 with a third signal being output at port 1310. In this reversed embodiment, the waveguide arms 1321 and 1331 can be considered to be input waveguide arms and 1311 is an output waveguide arm. In an aspect, when operating as a waveguide combiner a first waveguide port (e.g., 120, 720, 1320) can be configured to receive a first receive signal and a second waveguide port (e.g., 130, 730, 1330) can be configured to receive a second receive signal. In an aspect, the first receive signal and second receive signal can be in-phase, and further, can be of any suitable frequency band.

What has been described above includes examples of one or more embodiments. It is, of course, not possible to describe every conceivable modification and alteration of the above structures or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. An unbalanced waveguide power divider-combiner, comprising:

a first waveguide arm, comprising a first end and an input port located at the first end;

a second waveguide arm that comprises a second port;

a third waveguide arm that comprises a third port, the first waveguide arm, the second waveguide arm and the third waveguide arm form a T-shape;

a main septum located at a junction between the first waveguide arm and the second waveguide arm, the main septum positioned opposite the input port and relative to a centerline of the input port, wherein the main septum has a length to divide a radio frequency (RF) energy injected at the input port into a first output RF energy and a second output RF energy, the first output RF energy is directed to the second port, and the second output RF energy is directed to the third port; and an input matching section, the input matching section located at a junction between the first waveguide arm, the second waveguide arm, and the third waveguide arm, wherein the input matching section is located offset to the centerline of the input port, wherein the offset of the input matching section causes a magnitude of the first output RF energy to be different to a magnitude of the second output RF energy.

2. The unbalanced waveguide power divider-combiner of claim 1, wherein the input port, the second port, and the third port have a respective height, width, and impedance in accordance with at least one of a waveguide standard or at least one customized value.

3. The unbalanced waveguide power divider-combiner of claim 1, further comprising an iris located on the third waveguide arm, the iris further causes the magnitude of the first output RF energy to be different to the magnitude of the second output RF energy.

4. The unbalanced waveguide power divider-combiner of claim 1, further comprising a first pair of septums located at the third waveguide arm, wherein the first pair of septums constrict flow of the second output RF energy into the third waveguide arm to cause a magnitude of the first output RF energy to be different to a magnitude of the second output RF energy.

5. The unbalanced waveguide power divider-combiner of claim 1, further comprising a notch, the notch is located in the first waveguide arm.

6. The unbalanced waveguide power divider-combiner of claim 1, wherein the first waveguide arm, the second waveguide arm and the third waveguide arm each have a stepped profile.

7. The unbalanced waveguide power divider-combiner of claim 6, wherein the junction of the first waveguide arm, the second waveguide arm and the third waveguide arm is formed by a first transformer region on the first waveguide arm having a thickness $t_1$, a second transformer region on the second waveguide arm having a thickness $t_2$, and a third transformer region on the third waveguide arm having a thickness $t_3$, wherein $t_1 \neq t_2 \neq t_3$, the thickness of the third transformer region relative to the thickness of the second transformer region causes the magnitude of the first output RF energy to be different to the magnitude of the second output RF energy.

8. The unbalanced waveguide power divider-combiner of claim 6, wherein the junction of the first waveguide arm, the second waveguide arm and the third waveguide arm is formed by a first transformer region on the first waveguide arm having a first width, a second transformer region on the second waveguide arm having a second width, and a third transformer region on the third waveguide arm having a third width, wherein the first width≠the second width≠the third width, the width of the third transformer region relative to the width of the second transformer region causes the magnitude of the first output RF energy to be different to the magnitude of the second output RF energy.

9. The unbalanced waveguide power divider-combiner of claim 1, wherein the divider-combiner is configured to operate with the RF energy having a frequency range of about 33 to about 38 GHz.

10. A method for fabricating an unbalanced waveguide power divider-combiner, wherein the waveguide power divider comprises a first waveguide arm having an input port located at a first end, a second waveguide arm having a first output port located at one end, and a third waveguide arm having a second output port located at one end, the first waveguide arm, the second waveguide arm and the third waveguide arm forming a T-shape, the method comprising:

determining respective dimensions of the input port, the first output port, and the second output port, for operating the waveguide power divider with a radio frequency (RF) signal of about 33 to about 38 GHz;

determining a respective length for each of the first waveguide arm, the second waveguide arm, and the third waveguide arm;

determining size and position of an input matching section on the unbalanced waveguide power divider, the input matching section being located at the junction between the first waveguide arm, the second waveguide arm, and the third waveguide arm, wherein the input matching section is located offset to the centerline of the input port, wherein the offset of the input matching section causes a magnitude of the first RF signal portion to be different to a magnitude of the second RF signal portion; and fabricating the unbalanced waveguide power divider such that:

the input port, the first output port, and the second output part have the respective dimensions;

the first waveguide arm, the second waveguide arm, and the third waveguide arm have the respective length; and the input matching section has the size and the position.

11. The method of claim 10, further comprising:

determining a size and position of a main septum located at a junction of the first waveguide arm, the second waveguide arm, and the third waveguide arm, wherein the main septum is located with respect to a centerline of the first waveguide arm, and has a length to facilitate dividing a radio frequency (RF) signal input into the waveguide power divider via the input port, wherein the RF signal is divided into a first RF signal portion and a second RF signal portion, the first RF signal portion being directed along the second waveguide arm, and the second RF signal portion being directed along the third waveguide arm.

12. The method of claim 10, further comprising:

determining size and position of an iris, the iris being located in the third waveguide arm, wherein the iris further increases the difference between the magnitude of the first RF signal portion and the magnitude of the second RF signal portion.

13. The method of claim 10, further comprising:

determining size and position of a pair of septums located at the third waveguide arm, wherein the pair of septums constrict flow of the second RF signal portion into the third waveguide arm to cause a magnitude of the first RF signal portion to be different to a magnitude of the second RF signal portion.

14. The method of claim 10, further comprising:

determining a number and size of a first plurality of stepped transformer regions to incorporate into the first waveguide arm, a number and size of a second plurality of stepped transformer regions to incorporate into the second waveguide arm, and a number and size of a third plurality of stepped transformer regions to incorporate into the third waveguide arm, wherein the number and size of the first plurality of stepped transformer regions reducing in height with respect to position relative to the input port and the junction, the number and size of the second plurality of stepped transformer regions increasing in height with respect to position relative to the first output port from the junction, the number and size of the third plurality of stepped transformer regions increasing in height with respect to position relative to the second output port from the junction.

15. The method of claim 14, further comprising:

determining a first height and a first width of a first stepped transformer region in the first plurality of stepped transformer regions, wherein the first stepped transformer is located at the T-shape junction;

determining a second height and a second width of a second stepped transformer region in the second plurality of stepped transformer regions, wherein the second stepped transformer region is located at the T-shape junction; and determining a third height and a third width of a third stepped transformer region in the third plurality of stepped transformer regions, wherein the third stepped transformer region is located at the T-shape junction, wherein the first stepped transformer region, the second stepped transformer region and the third stepped transformer region are located adjacent to each other, wherein the first height≠the second height≠the third height, and the first width≠the second width≠the third width, the difference in respective heights and respective widths cause a magnitude of the first portion of RF energy to be different to a magnitude of the second output RF energy.

16. An unbalanced waveguide power divider comprising:

a first waveguide arm, comprising:

a first end; and an input port located at the first end, the input port configured to transmit radio frequency (RF) energy into the power divider;

a second waveguide arm that comprises a first output port;

a third waveguide arm that comprises a second output port, and respective non-port ends of the first waveguide arm, the second waveguide arm and the third waveguide arm form a T-shape junction;

a main septum located at the junction, the main septum is positioned opposite the input port and relative to a centerline of the input port wherein the main septum has a length to divide the RF energy received at the input port into a first portion of RF energy and a second portion of RF energy, the first portion of RF energy is directed to the first output port, and the second portion of RF energy is directed to the second output port; and an input matching section, the input matching section located at a junction between the first waveguide arm, the second waveguide arm, and the third waveguide arm, wherein the input matching section is located offset to the centerline of the input port, wherein the offset of the input matching section causes a magnitude of the first output RF energy to be different to a magnitude of the second output RF energy.

17. The unbalanced waveguide power divider of claim 16, wherein the first waveguide arm further comprises a first plurality of stepped transformer regions, the second waveguide arm further comprises a second plurality of stepped transformer regions, and the third waveguide arm further comprises a third plurality of stepped transformer regions, wherein the number and size of the first plurality of stepped transformer regions reduce in height with respect to position relative to the input port towards the junction, the number and size of the second plurality of stepped transformer regions increase in height with respect to position relative to the first output port from the junction, the number and size of the third plurality of stepped transformer regions increase in height with respect to position relative to the second output port from the junction.

18. The unbalanced waveguide power divider of claim 17, wherein a first stepped transformer region in the first plurality of stepped transformer regions is located at the junction; a second stepped transformer region in the second plurality of stepped transformer regions is located at the junction, and a third stepped transformer region in the third plurality of stepped transformer regions is located at the junction, wherein the first stepped transformer region, the second stepped transformer region and the third stepped transformer region are located adjacent to each other, wherein:

the first stepped transformer region has a thickness $t_1$;

the second stepped transformer region has a thickness $t_2$; and the third stepped transformer region has thickness $t_3$, wherein $t_3>t_1>t_2$, the thickness $t_3$ relative to thickness $t_2$ causes a magnitude of the first portion of RF energy to be different to a magnitude of the second output RF energy.

19. The unbalanced waveguide power divider of claim 16, wherein the RF energy has a frequency in a frequency range of about 33 to about 38 GHz.

* * * * *